US007402191B2

(12) United States Patent
Oyama et al.

(10) Patent No.: US 7,402,191 B2
(45) Date of Patent: Jul. 22, 2008

(54) PROCESS FOR PRODUCING SINTERING FEEDSTOCK AND APPARATUS THEREFOR

(75) Inventors: Nobuyuki Oyama, Fukuyama (JP); Kanji Aizawa, Kurashiki (JP); Takayuki Ueki, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 553 days.

(21) Appl. No.: 10/497,304

(22) PCT Filed: Mar. 28, 2003

(86) PCT No.: PCT/JP03/03969

§ 371 (c)(1),
(2), (4) Date: Jun. 1, 2004

(87) PCT Pub. No.: WO2004/055224

PCT Pub. Date: Jul. 1, 2004

(65) Prior Publication Data

US 2005/0050995 A1 Mar. 10, 2005

(30) Foreign Application Priority Data

Dec. 17, 2002 (JP) ..... 2002-365207
Feb. 14, 2003 (JP) ..... 2003-036024

(51) Int. Cl.
*C22B 1/00* (2006.01)

(52) U.S. Cl. ..... 75/459; 266/171

(58) Field of Classification Search ..... 266/171, 266/177; 75/459, 751
See application file for complete search history.

(56) References Cited

U.S. PATENT DOCUMENTS 5,520,719 A * 5/1996 Okuno et al. ..... 75/758
2006/0112786 A1 * 6/2006 Pammer et al. ..... 75/771

FOREIGN PATENT DOCUMENTS

JP A 2000-290732 10/2000
JP A 2002-285250 10/2002
JP 2002-332526 * 11/2002

OTHER PUBLICATIONS

English language translation of JP 2002-332526 Nov. 2002.*

* cited by examiner

*Primary Examiner*—Scott Kastler
(74) *Attorney, Agent, or Firm*—Oliff & Berridge, PLC

(57) ABSTRACT

As a pretreatment of a manufacturing process of sintered ore, a sintering material including iron ore, a $SiO_2$-containing material, a limestone base powdery material and a solid fuel type powdery material is projected as a additional coating auxiliary raw material into the drum mixer with a additional coating conveyor disposed in proximity to an exhaust outlet of the drum mixer. Preferably, a sintering material excepting a limestone base powdery material and a solid fuel type powdery material is charged from a charge inlet of the drum mixer to granulate and in a region disposed on a downstream side, an additional coating auxiliary raw material including a limestone base powdery material and a solid fuel type powdery material is added, and thereby until reaching the exhaust outlet, the additional coating auxiliary raw material is deposited and formed on a exterior coating portion of the sintering material.

17 Claims, 14 Drawing Sheets

Related Art

Related Art

| | DISTRIBUTION OF Ca | DISTRIBUTION OF Fe |
|---|---|---|
| CONVENTIONAL METHOD | | |
| LIMESTONE EXTERIOR COATING EXTERIOR COATING TIME 60 SECONDS | | |
| LIMESTONE EXTERIOR COATING EXTERIOR COATING TIME 360 SECONDS | | |

2mm

PROCESS FOR PRODUCING SINTERING FEEDSTOCK AND APPARATUS THEREFOR

TECHNICAL FIELD

The present invention relates to a manufacturing method of a material for sintering that is used when sintered ores for a blast furnace are manufactured by use of a Dwight-Lloyd type sintering machine of downward suction system, and a manufacturing apparatus thereof.

BACKGROUND ART

Sintered ores that are used as a material for blast furnaces are generally manufactured by undergoing a treatment process of a sintering material as shown below. As shown in FIG. 1, at first, iron ores M1 with a particle size of 10 mm or less, an $SiO_2$-containing material M2 including silica rock, serpentine rock or nickel slag, a CaO-containing limestone base powdery material M3 such as limestone, and a solid fuel type powdery material M4 that is a heat source such as powdery coke or anthracite are mixed together with an appropriate amount of water followed by granulating by means of a drum mixer 4, and thereby granulated products called as pseudo-particles are formed.

The blended material including the granulated products is charged on a pallet of a Dwight-Lloyd sintering machine with an appropriate thickness of, for instance, 500 to 700 mm, a solid fuel at a surface thereof is ignited, after the ignition, the solid fuel is combusted with air sucking downwardly, and, by the combustion heat, the blended sintering material is sintered to be a sintered cake. The sintered cake is pulverized and screened, and thereby sintered ores having a particle size larger than a predetermined diameter are obtained. On the other hand, ores having a particle size smaller than the predetermined diameter are returned and used again as the sintering material.

The reducibility of the sintered ore product thus manufactured is, as so far pointed out, a factor that largely controls an operation particularly of the blast furnace. Ordinarily, the reducibility of the sintered ores is defined according to JIS M8713 (JIS: Japanese Industrial Standard, hereinafter referred to as JIS), and here the reducibility of the sintered ores is denoted with JIS-RI.

As shown in FIG. 2, there is a positive correlation between the reducibility (JIS-RI) of the sintered ores and a gas utilization factor ($\eta_{co}$) in the blast furnace, and furthermore, as shown in FIG. 3, there is a negative correlation between the gas utilization factor ($\eta_{co}$) in the blast furnace and a fuel ratio. Accordingly, the reducibility (JIS-RI) of the sintered ores is in an excellent negative correlation with the fuel ratio through the gas utilization factor ($\eta_{co}$) in the blast furnace. As a result, when the reducibility of the sintered ores is improved, the fuel ratio in the blast furnace decreases.

The gas utilization factor ($\eta_{co}$) and the fuel ratio are defined as follows.

$$\text{Gas utilization factor } (\eta_{co}) = CO_2\ (\%)/(CO\ (\%) + CO_2\ (\%))$$

Here, $CO_2$ (%) and CO (%) each mean volume % in a furnace top gas of the blast furnace.

$$\text{Fuel ratio} = (\text{amount of coal+coke used (kg)})/\text{amount of pig (1 ton)}$$

Furthermore, the cold strength of the sintered ore product thus manufactured is also an important factor for securing the ventilation in the blast furnace. In the individual blast furnaces, the lower limit of the cold strength is set and operated.

Accordingly, the sintered ores preferable for the blast furnace are one that is excellent in the reducibility and high in the cold strength. In Table 1, the reducibility and the tensile strength of four main ore textures that constitute the sintered ores, that is, calcium ferrite (CF): $nCaO.Fe_2O_3$, hematite (He): $Fe_2O_3$, calcium silicate containing FeO (CS): $CaO.xFeO.\ ySiO_2$, and magnetite (Mg): $Fe_3O_4$ are shown. As shown in Table 1, one that is high in the reducibility is hematite (He) and one that is high in the tensile strength is calcium ferrite (CF).

The desired sintered ore structure that the invention intends is, as shown in FIG. 4, one that has calcium ferrite (CF) high in the strength generated on a surface of the sintered ore and has hematite (He) high in the reducibility selectively generated toward the inside of the sintered ore. Calcium silicate (CS) low in the reducibility and the strength should not be formed as far as possible.

However, so far, as mentioned above, the iron ore M1, $SiO_2$-containing material M2, limestone base powdery material M3 and solid fuel type powdery material M4 are simultaneously mixed and granulated. Accordingly, as shown in FIG. 5, in the pseudo particle structure, there are powdery ores, lime, and coke mixed in the surroundings of coarse seed ores. Accordingly, in the sintered ore structure obtained by the sintering, four ore textures of hematite (He), calcium ferrite (CF), calcium silicate (CS) and magnetite (Mg) are mingled.

In this connection, so far, various methods have been tried so as to produce much calcium ferrite (CF) and hematite (He). For instance, calcium silicate (CS) is produced a lot when the sintering is carried out at high temperatures. Accordingly, in Japanese Unexamined Patnt Application Publication No. 63-149331, a technology is proposed in which powdery iron ore, together with a binder and limestone, is granulated followed by coating powdery coke that is a heat source on a surface to improve the combustibility of coke, this is sintered at low temperatures and thereby the reducibility is improved.

However, according to the conventional method proposed in Japanese Unexamined Patnt Application Publication No. 63-149331, since CaO and $SiO_2$ in the iron base material or $SiO_2$ base material are in proximity to each other, calcium silicate (CS) is inevitably produced much. Accordingly, in many cases, a structure mainly including calcium ferrite (CF) and hematite (He) is not necessarily obtained.

Furthermore, Japanese Unexamined Patnt Application Publication No. 63-69926 proposes a technology in which after powdery iron ore and/or returned ore is mixed, to the mixed powdery iron ore and/or returned ore limestone, powdery coke and auxiliary raw materials such as scale and silica rock are added to form pseudo particles, thereby the powdery coke can be deposited much on an outer periphery portion of the pseudo particle, thereby the combustion speed of the powdery coke is accelerated, resulting in shortening the combustion time.

However, according to the conventional method proposed in Japanese Unexamined Patnt Application Publication No. 63-69926, since limestone and silica rock in the auxiliary raw materials are present together, calcium silicate (CS) weakest in the tensile strength is produced a lot, resulting in fragile sintered ores low in the strength.

Still furthermore, Japanese Unexamined Patnt Application Publication No. 11-241124 discloses a method of manufacturing low $SiO_2$ sintered ores in which, after iron ore powder, returned ores, part or whole of calcined lime and limestone and part or whole of $SiO_2$ source material are mixed and granulated by use of a primary mixer, powdery coke divided from another system and the slug source such as silica rock and lime are added to the mixed and granulated material followed by granulating by use of a secondary mixer, thereby on a surface portion of the granulated particle a layer of powdery coke and slug source is formed, and thus obtained material is sintered to obtain the low $SiO_2$ sintered ores.

However, according to the technology disclosed in Japanese Unexamined Patnt Application Publication No. 11-241124, in an exterior coating portion of the granulated particle (that is, one corresponding to a pseudo-particle of the invention), the low $SiO_2$-containing material is likely to enter. Thereby, calcium silicate (CS) lowest in the tensile strength among constituent ores of the sintered ore as shown in Table 1 is formed, resulting in lowering the Chatter Index or the Tumbler Index that denotes the cold strength. Furthermore, inside of the granulated particle, the material partially containing limestone enters; accordingly inside of the sintered ore, not only hematite (He) high in the reducibility but also calcium ferrite (CF) inferior in the reducibility to hematite (He) and calcium silicate (CS) much inferior in the reducibility to the hematite (He) are formed; as a result, a dramatic improvement effect in the reducibility cannot be obtained.

Furthermore, Japanese Unexamined Patnt Application Publication No. 61-163220 discloses a pre-treatment method of the sintering material. In the method, a sintering material, in which, pellet is mixed while the humidity therein is controlled, is mixed by use of a primary mixer and subsequently, powdery coke is added to the humidity-controlled and granulated substance which is then subjected to rollintg granulation by use of a secondary mixer.

However, according to the technology disclosed in Japanese Unexamined Patnt Application Publication No. 61-163220, since the material containing limestone enters inside of the pseudo particles, inside of the sintered ores, not only hematite (He) high in the reducibility but also calcium ferrite (CF) inferior in the reducibility to hematite (He) and calcium silicate (CS) remarkably inferior in the reducibility to the hematite (He) are formed. Accordingly, not only the dramatic improvement effect of the reducibility cannot be obtained, but also in the outside of the sintered ore where the cold strength has to be secured, calcium silicate (CS) lowest in the tensile strength among the ingredient ores of the sintered ore is formed, resulting in decreasing in the Chatter Index or the Tumbler Index that denotes the cold strength.

As disclosed in Japanese Unexamined Patnt Application Publication Nos.61-163220, 63-69926 and 11-241124, in the pre-treatment method or manufacturing method of the sintering material in which with the primary and secondary mixers, the mixing and granulation are carried out, fundamentally the primary mixer performs the mixing and granulation mainly consisting of the mixing of the sintering material, and thereafter, the secondary mixer carries out the granulation. When there are the primary and secondary mixers like this (when there are two mixers in total), ordinarily, for the mixing and granulation of the sintering material in the primary mixer, substantially 120 seconds are secured, and for the granulation in the secondary mixer, substantially 180 seconds are secured.

Furthermore, as to the additional coating of powdery coke and limestone, in Japanese Unexamined Patnt Application Publication No.2002-285250, an applicant the same as the present invention discloses a manufacturing method of a sintering material that the present invention intends to obtain. That is, there is proposed a granulation method in which by additionally coating powdery coke and limestone, so-called three-layer pseudo particles are obtained. The additional coating of powdery coke and limestone intends to deposit an auxiliary raw material including the additionally coated powdery coke and limestone on a surface of the pseudo particle. Thereby, to the pseudo particle with a first layer of a coarse particle and a second layer of fine particles surrounding the coarse particle, on a surface layer of the pseudo particle a third layer rich in powdery coke and limestone is formed, and thereby the reducibility JIS-RI value of the sintered ore can be improved.

However, even in the Japanese Unexamined Patnt Application Publication No. 2002-285250, it was found that when powdery coke and limestone were additionally coated in the course of granulation, in the drum mixer, other than an action of forming the pseudo particles owing to rolling of the drum mixer, breaking down of the pseudo particles was repeated in the course of the rolling; in this breaking down process, powdery coke and limestone were contained inside of the pseudo particles; as a result, powdery coke and limestone could not be coated on the surface of the pseudo particles.

Furthermore, in Japanese Unexamined Patnt Application Publication No. 2002-285250, powdery coke and limestone are additionally coated by inserting a belt conveyer into a drum mixer to add.

However, the aditional coating method described in Japanese Unexamined Patnt Application Publication No. 2002-285250, in particular a method that uses a belt conveyer has the following disadvantages. That is, deposit adhered to an inner wall of the drum mixer in the course of the granulation of the material for sintering falls down on the belt conveyer to adhere to and deposit on the belt conveyer. In order to remove the accretion and deposit, it takes a lot of labor. Furthermore, in some cases, a driving part of the belt conveyer is damaged and an operation is interrupted. Still furthermore, when the accretion on the belt conveyer becomes too large, the accretion comes into contact with the inner wall of the drum mixer, or the belt conveyer is bent owing to a weight of the accretion to come into contact with the inner wall of the drum mixer. It was found that such a contact of the inner wall of the drum mixer and the accretion gave rise to a large damage onto the inner wall of the drum mixer, other than the interruption of the operation was caused, there was a large problem also from the viewpoint of safety.

Furthermore, Japanese Unexamined Patnt Application Publication No. 58-189335 discloses another additional coating method. According to the method, over a region from an intermediate portion in a direction in which material in the drum mixer flows to an ore exhaust side (exhaust side), an air stream is used to inject and add from the exhaust side.

However, according to the method disclosed in Japanese Unexamined Patnt Application Publication No. 58-189335, equipment expense for an air stream generator that additionally coats auxiliary raw materials, apparatus for transferring additional coating additives and injection equipment becomes enormous. Furthermore, to a portion that is inside of the drum mixer of the injection equipment, the accretion falls from the inner wall of the drum mixer or dust powder adheres to apparatus portion, resulting in disturbing a smooth operation. Furthermore, according to the method, since the additional coating material is injected and added toward a charge side of the drum mixer by the air stream, the additional coating material is widely scattered within the drum mixer and reaches to the charge side of the drum mixer. As a result, a problem is caused in that since such auxiliary raw material that were scattered up to the charge side are contained in the sintering material in the course of granulation in the drum mixer, the intention of depositing the additional coating auxiliary raw material on the pseudo particle surface cannot be realized.

Still furthermore, a still another additional coating method is proposed in Japanese Unexamined Patnt Application Publication No. 2002-20820. According to the method, in a predetermined region on a sintering material charge side in the drum mixer, by making use of an air stream, a binder consisting limestone powder and hydrated lime and so on is dispersed and added.

However, even according to the method disclosed in Japanese Unexamined Patnt Application Publication No. 2002-20820, since a portion of the apparatus that projects the additional coating auxiliary raw material is always inside of the drum mixer, dust powder (calcined lime and so on) in the drum mixer adheres and solidly sticks to the portion of the apparatus and disturbs the operation. Accordingly, the maintenance operation that periodically interrupts the operation and pulls the portion of the apparatus out to remove the accretion is necessary. However, in the maintenance operation, since it is difficult to pull out the portion of apparatus, the maintenance operation takes a lot of time.

Furthermore, similarly to the Japanese Unexamined Patnt Application Publication No. 58-189335, the additional coating auxiliary raw material is widely scattered in the drum mixer and reaches up to the charge side of the drum mixer. The auxiliary raw material scattered up to the charge side is taken in the sintering material in the course of the granulation by the drum mixer, accordingly there is a problem in that the additional coating auxiliary raw material cannot be deposited onto the pseudo particle surface.

The present invention was carried out to overcome the above-mentioned conventional problems and intends to provide a manufacturing method of a material for sintering that can improve the cold strength and the reducibility of the sintered ore and apparatus therefor. The inventive manufacturing method includes, as a pre-treatment of a process of manufacturing sintered ore, without necessitating huge apparatus, forming pseudo particles by granulating iron ore M1 and $SiO_2$-containing material M2 separately from limestone base material M3 and solid fuel type material M4; and selecting a time to additionally coat limestone base material M3 and solid fuel type material M4 to gradually form pseudo particles, and thereby manufacturing sintered ore having a structure in which a layer rich in the limestone base material M3 and solid fuel type material M4 is formed on a surface portion of the pseudo particle, calcium ferrite (CF) high in the strength is generated on the surface of the sintered ore, and on the other hand toward the inside of the sintered ore, hematite (He) high in the reducibility is selectively formed.

In the present invention, iron ore of material for sintering includes coarse, powdery iron ore and returned ore that is again utilized as the sintering material, and with these generically referring as iron ore, the invention will be explained.

DISCLOSURE OF THE INVENTION

A first aspect of the invention for achieving the above object is a manufacturing method of a material for sintering. The manufacturing method is characterized in that when, with a Dwight-Lloyd type sintering machine of downward suction, as a pretreatment of a manufacturing process of sintered ore for use in a blast furnace, sintering material including iron ore M1, $SiO_2$-containing material M2, limestone base powdery material M3 and solid fuel type powdery material M4 is granulated by means of a drum mixer, the sintering material excepting the limestone base powdery material M3 and solid fuel type powdery material M4 is charged from a charge inlet of the drum mixer to granulate, and, in a region disposed in the middle on a downstream side where a staying time during which the sintering material reaches up to an exhaust outlet of the drum mixer is in the range of from 10 to 90 seconds, the limestone base powdery material M3 and solid fuel type powdery material M4 are added, and thereby until reaching the exhaust outlet, the limestone base powdery material M3 and solid fuel type powdery material M4 (hereinafter in the invention, limestone base powdery material M3 and solid fuel type powdery material M4 are referred to as additional coating auxiliary raw material 8) are deposited and formed on the exterior coating portion of the sintering material.

Furthermore, a second aspect of the invention is a manufacturing method of material for sintering characterized in that, in the first aspect, the sintering material excepting the limestone base powdery material M3 and solid fuel type powdery material M4 is charged from a charge inlet of the drum mixer to granulate, and, in a region disposed in the middle on a downstream side where a staying time during which the sintering material reaches an exhaust outlet of the drum mixer is in the range of from 10 to 90 seconds, after the limestone base powdery material M3 is added, the solid fuel type powdery material M4 is added, and thereby until reaching the exhaust outlet, the limestone base powdery material M3 and the solid fuel type powdery material M4 are deposited in turn and formed on the exterior coating portion of the sintering material.

Still furthermore, a third aspect of the invention is a manufacturing method of material for sintering characterized in that, in the first and second aspects, the drum mixer is divided into a plurality of drum mixers, a final drum mixer is made to have a drum mixer length disposed so that a staying time from the charge inlet up to the exhaust outlet may be in the range of from 10 to 90 seconds.

Furthermore, a fourth invention is a manufacturing method of material for sintering characterized in that, in the first and second aspects, the drum mixer is divided into a plurality of drum mixers, in a region disposed in the middle on a downstream side where a staying time during which the sintering material reaches up to an exhaust outlet of the final drum mixer is in the range of from 10 to 90 seconds, the limestone base powdery material M3 and solid fuel type powdery material M4 are added, and thereby until reaching the exhaust outlet, the limestone base powdery material M3 and solid fuel type powdery material M4 are deposited and formed on the exterior coating portion of the sintering material.

Still furthermore, a fifth aspect of the invention is a manufacturing apparatus of a sintering material characterized in that in a manufacturing apparatus including a drum mixer by which a sintering material is, while rolling and transferring, formed into pseudo particles; and a additional coating conveyer that projects the additional coating auxiliary raw material 8 in the middle of forming pseudo particles of the sintering material into the drum mixer, on an exhaust outlet side of the drum mixer, a additional coating conveyer is disposed so that an exhaust end thereof faces the exhaust outlet of the drum mixer.

Furthermore, a sixth aspect of the invention is characterized in that, in the fifth aspect, the additional coating conveyer can control an initial speed and/or an angle of elevation of a additional coating auxiliary raw material 8 when the additional coating auxiliary raw material 8 is projected into the drum mixer.

Still furthermore, a seventh aspect of the invention is a manufacturing apparatus of a sintering material characterized in that, in the fifth aspect, movement means for moving the additional coating conveyer so that the exhaust end of the additional coating conveyer may move between a predetermined position on an exhaust outlet side inside of the drum mixer and a position outside of the exhaust outlet of the drum mixer are disposed.

Furthermore, an eighth aspect of the invention is a manufacturing apparatus of a sintering material characterized in that, in the sixth or seventh aspect, speed control means for controlling a belt speed of the additional coating conveyer is disposed, and thereby a projection initial speed of the additional coating auxiliary raw material 8 that is projected into the drum mixer is made controllable.

Still furthermore, a ninth aspect of the invention is a manufacturing apparatus of a sintering material characterized in that, in the eighth aspect, a predetermined position on an exhaust outlet side inside of the drum mixer where the exhaust end of the additional coating conveyer is located and the belt speed of the additional coating conveyer are controlled so that the projection position of the additional coating auxiliary raw material 8 may be a region disposed in the middle on a downstream side where a staying time of the sintering material until reaching the exhaust outlet of the drum mixer is in the range of from 10 to 90 seconds.

BEST MODE FOR CARRYING OUT THE INVENTION

In the following, situations that led to the completion of the present invention and a gist of specific modes for carrying out the invention will be explained with reference to the drawings.

In the invention, it was found that when a time for adding in particular a limestone base powdery material M3 and a solid fuel type powdery material M4 to deposit and form on a exterior coating portion of a sintering material was set, that is, when after the limestone base powdery material M3 and solid fuel type powdery material M4 are additionally coated and added to the sintering material that is being granulated, a staying time after the addition until the sintering material reaches the exhaust outlet of the drum mixer, so-called granulation period of time (hereinafter simply referred to as "exterior coating time") after the limestone base powdery material M3 and solid fuel type powdery material M4 are added to deposit and form on the exterior coating portion of the sintering material was set, the effect was largely different.

Figure 6:
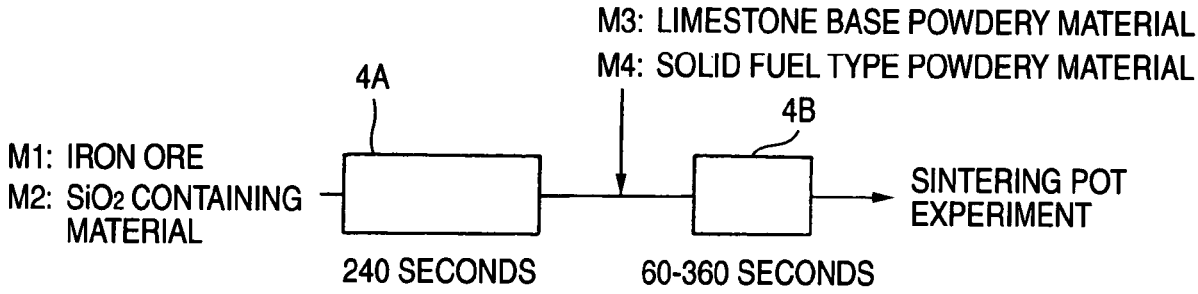
FIG. 6 is a diagram explaining a method of exterior coating experiment of a limestone base powdery material and a solid fuel type powdery material.

As shown in FIG. 6, an experiment was carried out in such way that with the granulation period of time of the sintering material (the iron ore M1 and $SiO_2$-containing material M2) excepting the limestone base powdery material M3 and solid fuel type powdery material M4 fixed constant (240 seconds), the exterior coating period of time of the limestone base powdery material M3 and solid fuel type powdery material M4 was varied from 60 seconds to 360 seconds.

Figure 7:
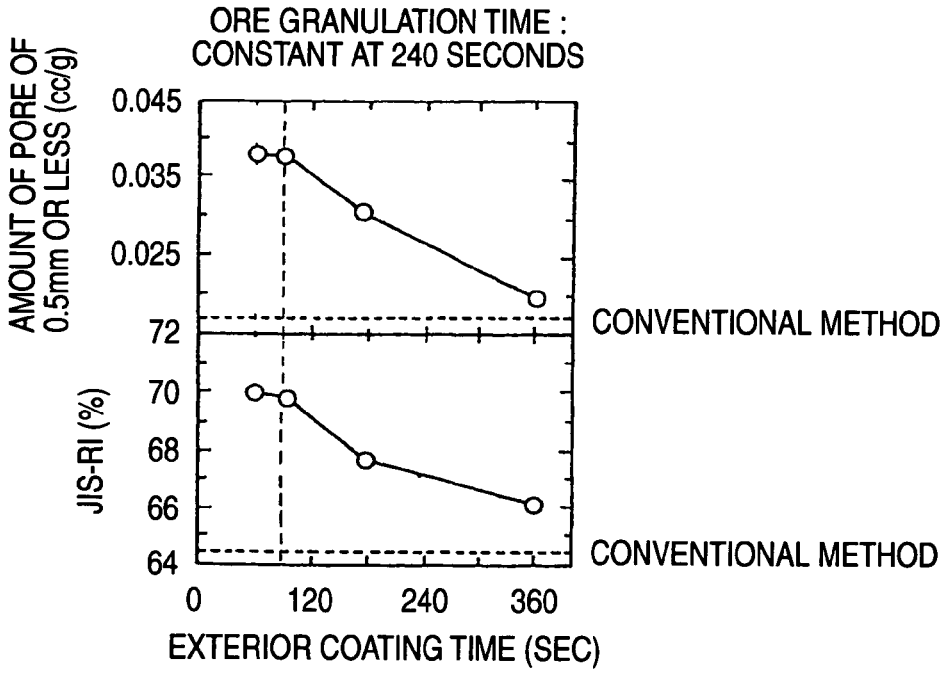
FIG. 7 is a characteristic diagram showing relationship between exterior coating period of time vs. the reducibility JIS-RI (%) and pore volume (cc/g) of the sintered ore.

As a result, as shown in FIG. 7, it was found that as the exterior coating period of time became longer, fine pores of 0.5 mm or less effective in an improvement in the reducibility decreased, the reducibility deteriorated, and the exterior coating period of time was desirably 90 seconds or less. Measurement of the pore volume was performed by a mercury push-in method with a mercury porosimeter. Furthermore, from another experiment, it was found that when the exterior coating period of time was less than 10 seconds, because of insufficiency of the exterior coating period of time, added limestone base powdery material and solid fuel type powdery material partially segregated, a uniform sintered state could not be obtained, and an effect according to the invention was not exhibited.

Here, a exterior coating region inside of the mixer where the exterior coating period of time is from 10 to 90 seconds corresponds to, in terms of the number of revolution of the sintering material in the drum mixer, 2 to 36 revolutions, and to 0.5 to 5 m from exhaust outlet end 35 of the drum mixer 4. However, as far as the exterior coating period of time in the mixer is controlled so as to be in the range of from 10 to 90 seconds, a dimension of the exterior coating region is not restricted to the above dimension.

Figures 8, 9:
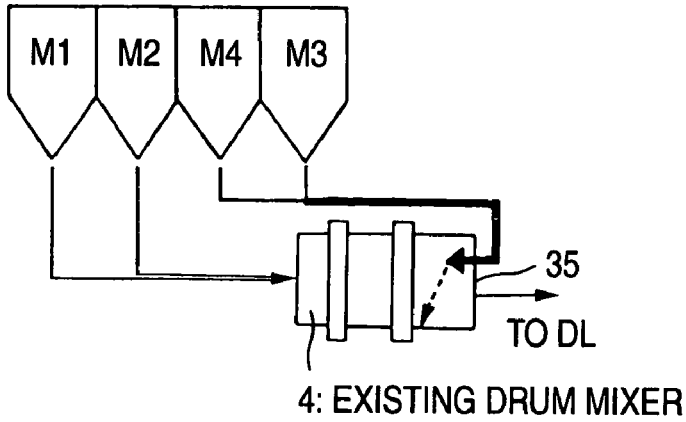
FIG. 8 is a diagram showing distributions of Ca and Fe in a pseudo particle when the exterior coating period of time is varied.
FIG. 9 is a diagram schematically explaining a mode for carrying out the present invention.

In FIG. 8, results of distribution investigation of Ca and Fe in pseudo particles of the sintering material by electron probe microanalysis (hereinafter simply referred to as EPMA) are shown. Therefrom, it can be confirmed that when the exterior coating period of time is properly set (60 seconds in this experiment), the distribution of Ca becomes outer-ring like; that is, exterior coating is achieved. On the other hand, when the exterior coating period of time is made longer (360 seconds in the comparative example), particles are destroyed in the drum mixer and limestone is contained in the pseudo particles. As a result, Ca distributes at large and there is no difference from the conventional method.

In other words, since in the drum mixer, not only the granulation but also the destruction of the pseudo particles simultaneously proceeds, when the exterior coating period of time is set longer than necessary, the limestone base powdery material M3 and solid fuel type powdery material M4 that are added to externally coat are contained owing to the destruction of the pseudo particles and exist in both inner and outer exterior coating. It is confirmed that, as a result, sintered ore having a structure in which on the surface of the sintered ore calcium ferrite (CF) high in the strength is generated, on the other hand toward the inside of the sintered ore hematite (He) high in the reducibility is selectively formed cannot be obtained. That is, proper selection of the exterior coating period of time was found to be important.

Furthermore, as mentioned above, when the exterior coating period of time is set too short, the added limestone base powdery material M3 and solid fuel type powdery material M4 segregate in the sintering material, resulting in non-uniform sintering of the sintering material on the sintering machine. Then, the inventors investigated the exterior coating period of time that does not cause the segregation; as a result, it was found that the exterior coating period of time of 10 seconds or more was necessary. That is, there is a disadvantage in that the exterior coating period of time is under stringent condition, and simple addition of the auxiliary raw material in a later half portion in the drum mixer allows containing the auxiliary raw material inside of the pseudo particle.

When the condition on the exterior coating period of time according to the invention is satisfied, the limestone base powdery material M3 and solid fuel type powdery material M4 can be for the first time externally coated without being contained inside thereof (inner exterior coating); accordingly, a material for sintering is manufactured with, inside of the pseudo particle, the $SiO_2$-containing material M2 separated from the limestone base powdery material M3, that is, without limestone. Thereby, CaO and $SiO_2$ are delayed in the reaction, resulting in suppressing calcium silicate (CS) poor in the reducibility and low in the cold strength from generating.

In the invention, at the interface between the exterior coated limestone base powdery material and iron ore, a calcium ferrite (CF) system melt is formed and covers a circumference of the iron ore, resulting in exhibiting sufficient cold strength. When sintering is performed with this material for sintering, a sintered ore in which calcium ferrite (CF) high in the strength is formed on the surface of the sintered ore and hematite (He) high in the reducibility is selectively formed toward the inside of the sintered ore can be formed.

Figure 10:
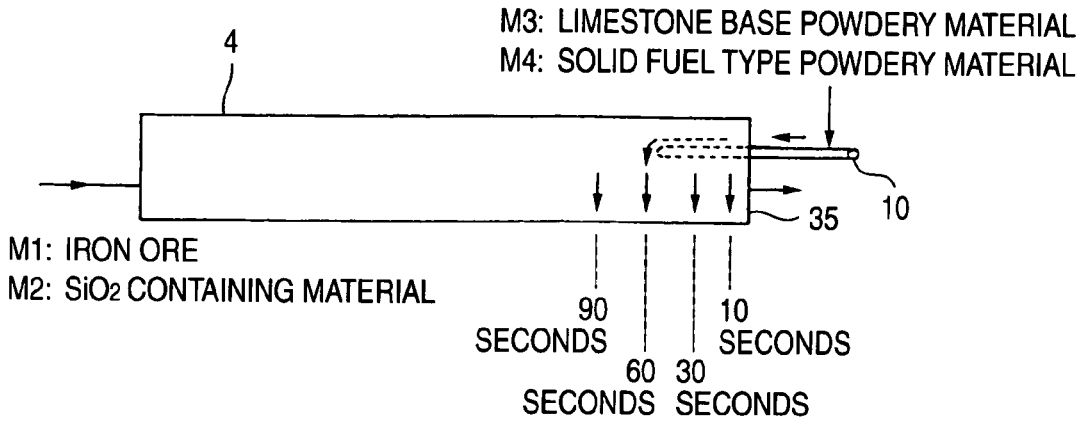
FIG. 10 is a diagram showing a mode for carrying out the invention (method A).

An example of granulation flow (method A) according to the invention is shown in FIGS. 9 and 10. As shown in FIG. 9, from a charge side of the drum mixer 4, a sintering material (iron ore M1 and $SiO_2$-containing material M2) excepting limestone and powdery coke that are, respectively, the limestone base powdery material M3 and solid fuel type powdery material M4 is charged, and in order to control the exterior coating period of time, the limestone and powdery coke are added from exhaust side 35 of the drum mixer.

As mentioned above, in order to obtain the sintering material adequate for the sintered ore, an additional coating position in the drum mixer 4 of the auxiliary raw material that is the limestone base powdery material M3 and solid fuel type powdery material M4 is important. When the additional coating position of the auxiliary raw material is in a forward end portion in the drum mixer 4, since the pseudo particles that become seed particles have not been sufficiently formed and grown, additionally coated auxiliary raw material is taken into the inside of the pseudo particles. On the other hand, even when the additional coating position of the auxiliary raw material is in an intermediate portion in the drum mixer 4, since in the drum mixer 4, the granulation action (formation of pseudo particles) of the sintering material and the destruction action thereof are simultaneously proceeding, the additional coating auxiliary raw material 8 is taken into the inside of the destroyed pseudo particles. Accordingly, the object to manufacture pseudo particles having a three-layer structure with a layer rich in powdery coke in the outer-most layer cannot be achieved. Furthermore, when the additional coating position of the auxiliary raw material is too close to a back end portion in the drum mixer 4, the additionally coating auxiliary raw material does not uniformly adhere to the outer-most layer of the pseudo particles, in some cases, remains coagulated without adhering, resulting in disturbing a smooth proceeding of the sintering. Accordingly, it is better to additionally coat the auxiliary raw material in a region disposed in the middle on a downstream side where a staying time until the sintering material reaches the exhaust outlet 35 of the drum mixer is in the range of from 10 to 90 seconds.

Figure 16:
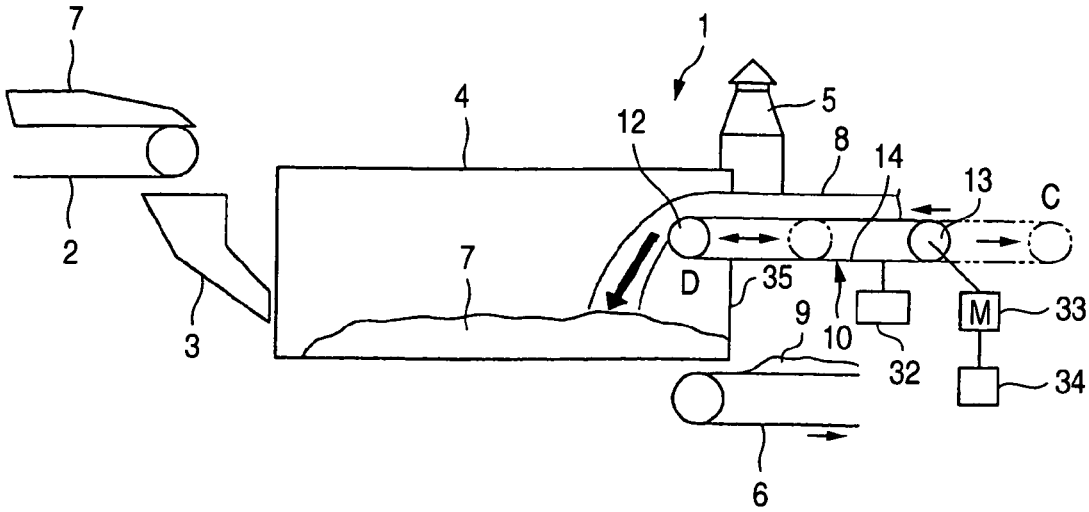
FIG. 16 is a side view showing an outline of manufacturing apparatus of the sintering material involving one mode for carrying out the invention.

Such additional coating can be performed by projecting the additional coating auxiliary raw material 8 from back end portion 35 of the drum mixer. However, as shown in FIG. 16, it is better to dispose additional coating conveyer 10 that can project the additional coating auxiliary raw material 8 from an exhaust end D of the additional coating conveyer 10 in proximity to the exhaust outlet of the drum mixer to a predetermined range in the drum mixer to additionally coat. FIG. 10 shows a preferable specific example thereof, and in the example, in accordance with a exterior coating region disposed in the middle on a downstream side of the drum mixer 4 where a staying time until the material for sintering reaches the exhaust outlet 35 is in the range of from 10 to 90 seconds, a tip end position D of the belt conveyer 10 disposed freely movable from the exhaust outlet 35 on the downstream side in a longer direction in the drum mixer 4 is controlled so as to position in an intermediate position of the exterior coating region that corresponds to, for instance, 60 seconds in the range of from 10 to 90 seconds.

Subsequently, through the belt conveyer 10, the limestone base powdery material M3 (for instance, powdery limestone) and solid fuel type powdery material M4 (for instance, powdery coke) are added to a predetermined region (here, an intermediate position of the exterior coating region), and pseudo particles having a exterior coating portion where on circumference of pseudo particles formed by granulation until reaching the exterior coating region in the drum mixer 4, the limestone base powdery material M3 and solid fuel type powdery material M4 are deposited and formed are granulated. The limestone base powdery material M3 and solid fuel type powdery material M4, when an average particle size is made 1.5 mm or less and preferably 1.0 mm or less, can adhere to the exterior coating portion with ease and can cover outer surface thereof. The method A is a case where a single drum mixer is used.

Figure 11A:
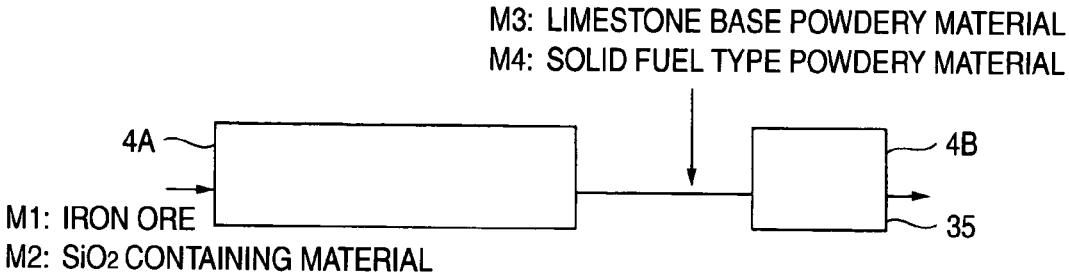
FIG. 11A is a diagram showing another mode for carrying out the invention (method B).
Figure 11B:
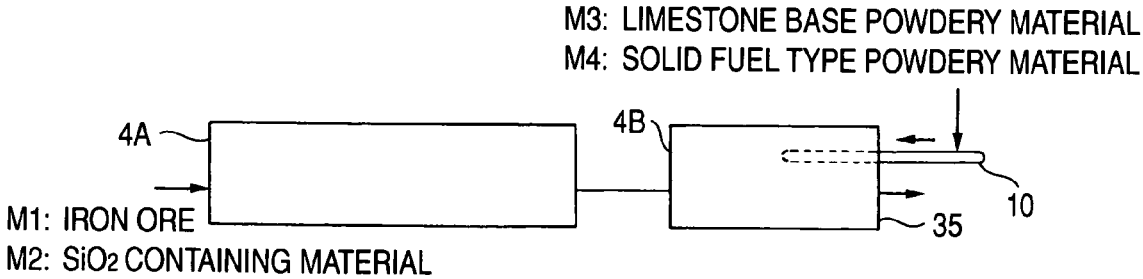
FIG. 11B is a diagram showing another mode for carrying out the invention (method B).

Furthermore, in FIGS. 11A and 11B, an example of granulation flow (method B) according to which a desirable pseudo particle structure according to another invention is manufactured is shown. The example of granulation flow (method B) is an example in which the drum mixer 4 shown in FIG. 10 is divided into a plurality of sections in a longer direction, in the present example a two-division type being shown. In FIG. 11A, a first drum mixer 4A where the sintering material excepting the limestone base powdery material M3 and solid fuel type powdery material M4 is charged and granulated to obtain pseudo particles, and a second drum mixer 4B where pseudo particles having a exterior coating portion where on the circumference of the pseudo particles granulated in the first drum mixer 4A, the limestone base powdery material M3 and solid fuel type powdery material M4 are deposited are granulated are disposed in series. The first drum mixer 4A has a length during which pseudo particles can be granulated, and the second drum mixer 4B has a length during which on the outer periphery of the pseudo particle the limestone base powdery material M3 and solid fuel type powdery material M4 that is a heat source can be exterior coated and deposited. That is, the length of the second drum mixer 4B has a dimension corresponding to the exterior coating region where a staying time of the pseudo particle until the pseudo particle reaches from the charge inlet to exhaust outlet 35 is in the range of from 10 to 90 seconds.

In this case, from a charge inlet of the first drum mixer 4A, iron ore M1 and $SiO_2$-containing material M2 (material containing relatively much $SiO_2$ such as silica rock, serpentine rock, and Ni slag) excepting the limestone base powdery material M3 and solid fuel type powdery material M4 are charged. While repeating the granulation and destruction in the course until reaching from the charge inlet of the first drum mixer 4A to the exhaust outlet, with a coarse particle of iron ore M1 as a seed particle and with fine particles of iron ore and the $SiO_2$-containing material M2 deposited on the circumference of the coarse particle of iron ore, a pseudo particle is granulated. Thereafter, when the pseudo particles are charged into a charge inlet of the second drum mixer 4B, the limestone base powdery material M3 and solid fuel type powdery material M4 that becomes a heat source are fed to a charge inlet of the second drum mixer 4B. Thereby, in the second drum mixer 4B, on the circumference of the pseudo particles, the limestone base powdery material M3 and solid fuel type powdery material M4 are exterior coated and deposited, and thereby the granulation is performed.

In FIG. 11B, an application example of the invention where the existing drum mixer 4 is divided into two sections is shown. When a length of a drum mixer 4B that is a later half portion is longer than a length that corresponds to 90 seconds of the exterior coating time, similarly to the example shown in FIG. 10, from an exhaust side of the drum mixer 4B of the later half portion, by means of belt conveyer 10, in the exterior coating region, the limestone base powdery material M3 and solid fuel type powdery material M4 that becomes a heat source are supplied and added.

Figure 12A:
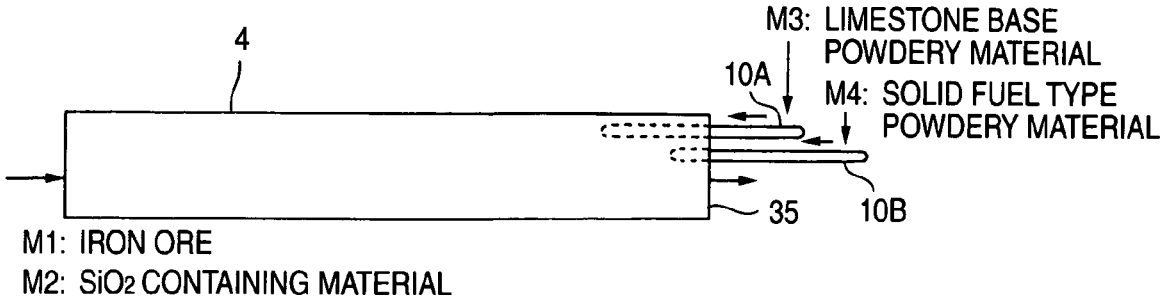
FIG. 12A is a diagram showing still another mode for carrying out the invention (method C).
Figure 12B:
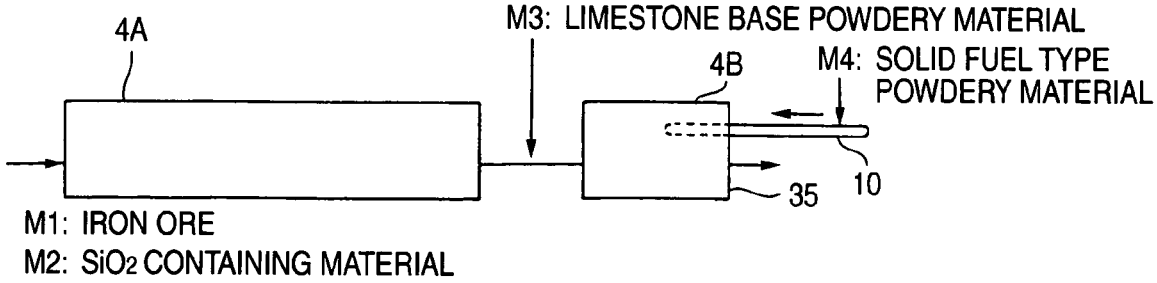
FIG. 12B is a diagram showing still another mode for carrying out the invention (method C).

Furthermore, FIGS. 12A and 12B show specific examples of a manufacturing method (method C) of a material for sintering where in the exterior coating region disposed in the middle on a downstream side of which staying time is in the range of from 10 to 90 seconds, after the limestone base powdery material M3 is added, the solid fuel type powdery material M4 is added, and during reaching the exhaust outlet 35, on the exterior coating portion of the pseudo particle of the sintering material, the limestone base powdery material M3 and solid fuel type powdery material M4 are in this order deposited and formed. FIG. 12A shows a mode where from exhaust side 35 of a single drum mixer 4 to the exterior coating region, the limestone base powdery material M3 and solid fuel type powdery material M4 that becomes a heat source, respectively, are supplied and added by use of belt conveyers 10A and 10B. Furthermore, FIG. 12B shows a specific example when a drum mixer is divided into two. In this mode, at a charge side of the drum mixer 4B disposed to be a dimension corresponding to a exterior coating region in the range of from 10 to 90 seconds, the limestone base powdery material M3 is supplied and added, and from the exhaust side 35 of the drum mixer 4B to the exterior coating region, by means of the belt conveyer 10, the solid fuel type powdery material M4 that becomes a heat source is supplied and added. By adding to the exterior coating region, on the exterior coating portion of the pseudo particle, the limestone base powdery material M3 and solid fuel type powdery material M4 are successively deposited and formed. In this addition mode, when after the addition of the limestone base powdery material M3, the solid fuel type powdery material M4 is added at a position having a time difference of more than 10 seconds, on the exterior coating portion of the pseudo particle, after an adhesion layer of the limestone base powdery material M3 is formed, the solid fuel type powdery material M4 is further deposited and formed.

According to (method A) or (method B) of the invention, with a coarse iron ore M1 as a seed particle, to the periphery thereof fine iron ore M1 and $SiO_2$-containing material M2 can be deposited, furthermore in the periphery thereof the limestone base powdery material M3 and solid fuel type powdery material M4 (coke) that becomes a heat source can be deposited and formed to the exterior coating portion. Furthermore, according to the (method C) of the invention, when the limestone base powdery material M3 and solid fuel type powdery material M4 (coke) that becomes a heat source are deposited and formed on the exterior coating portion, the solid fuel type powdery material M4 (coke) that becomes a heat source can be deposited and formed on the outer-most exterior coating portion.

Thereby, in the invention, from a charge inlet of the drum mixer 4 the sintering material excepting the limestone base powdery material M3 and solid fuel type powdery material M4 is charged to granulate and in a region disposed in the middle on a downstream side where a staying time during which the sintering material reaches the exhaust outlet 35 of the drum mixer 4 is in the range of from 10 to 90 seconds the limestone base powdery material M3 and solid fuel type powdery material M4 are added. Accordingly, according to the inventive method, since until reaching the exhaust outlet 35, the limestone base powdery material M3 and solid fuel type powdery material M4 can be deposited and formed on the exterior coating portion of the sintering material, in the course of sintering of the material for sintering, a reaction between CaO and $SiO_2$ belatedly occurs, resulting in suppressing calcium silicate (CS) low in the cold strength from generating. As a result, on the surface of the sintered ore calcium ferrite (CF) high in the strength is generated, and toward the inside of the sintered ore hematite (He) high in the reducibility is selectively generated. Thereby, the sintered ore rich in fine pores, excellent in the reducibility and high in the cold strength can be stably manufactured.

Furthermore, in a method of manufacturing material for sintering where as a pretreatment to the process according to which sintered ore for a blast furnace is manufactured by use of a Dwight-Lloyd type sintering machine of downward suction, when a sintering material including iron ore M1, $SiO_2$-containing material M2, limestone base powdery material M3 and solid fuel type powdery material M4 is granulated by use of the drum mixer 4, from the charge inlet of the drum mixer 4, the sintering material excepting the limestone base powdery material M3 and solid fuel type powdery material M4 is charged and granulated and in a region disposed in the middle on a downstream side where a staying time during which the sintering material reaches the exhaust outlet 35 of the drum mixer 4 is in the range of from 10 to 90 seconds the limestone base powdery material M3 is added followed by adding the solid fuel type powdery material M4, and thereby during reaching the exhaust outlet, on the exterior coating portion of the sintering material, the limestone base powdery material M3 and solid fuel type powdery material M4 are deposited and formed in this order, as mentioned above, toward the inside of the sintered ore hematite (He) high in the reducibility is selectively generated and the sintered ore rich in the fine pores, excellent in the reducibility and high in the cold strength can be stably manufactured, in addition, the solid fuel type powdery material M4 that becomes a heat source can be deposited and formed on the outer-most portion of the exterior coating portion, resulting in obtaining an improvement in the combustibility of the added solid fuel type powdery material M4.

In the next place, manufacturing apparatus will be explained.

FIG. 16 is a side view showing an outline of manufacturing apparatus of a sintering material involving one mode for carrying out the invention.

In FIG. 16, manufacturing apparatus 1 of the sintering material includes raw material conveyer 2 that transfers sintering material 7, shoot 3 that equally divides the transferred sintering material 7 excepting the limestone base powdery material M3 and solid fuel type powdery material M4 into drum mixer 4, drum mixer 4 that while rolling and transferring the sintering material 7 forms pseudo particles, additional coating conveyer 10 that projects additional coating auxiliary raw material (the limestone base powdery material M3 and solid fuel type powdery material M4) 8 into the drum mixer 4 in the middle of forming the pseudo particles of the sintering material 7, hood (exhaust fan) 5 for exhausting dust powder from the inside of the drum mixer 4, and ore exhaust conveyer 6 by which sintering material 9 after formation of the pseudo particles is transferred to a sintering machine. The additional coating conveyer 10 and ore exhaust conveyer 6 are disposed in proximity to the exhaust outlet 35 of the drum mixer 4. The sintering material 7 generally, includes the $SiO_2$-containing material M2 that includes iron ore (including returned ore), silica rock, serpentine rock or nickel slag having a particle size of 10 mm or less. On the other hand, the additional coating auxiliary raw material 8 includes the CaO containing limestone base powdery material M3 such as calcined lime, limestone and so on and the solid fuel type powdery material M4 that becomes a heat source such as powdery coke or anthracite coal.

In the next place, an example of the apparatus according to the invention will be detailed. In the apparatus shown in FIG. 16, the additional coating conveyer 10 is provided with transfer means 32 for transferring the additional coating conveyer 10 in a direction substantially along a longer direction of the drum mixer 4, the exhaust end D of the additional coating conveyer 10 being disposed so as to move between a predetermined position (forwarding position) on an exhaust outlet side in the drum mixer 4 and an outside position (receding position shown with a chain double-dashed line) of the exhaust outlet 35 of the drum mixer 4. The exhaust end D of the additional coating conveyer 10 can be stopped at an arbitrary position between the forwarding position and the receding position.

Figure 18:
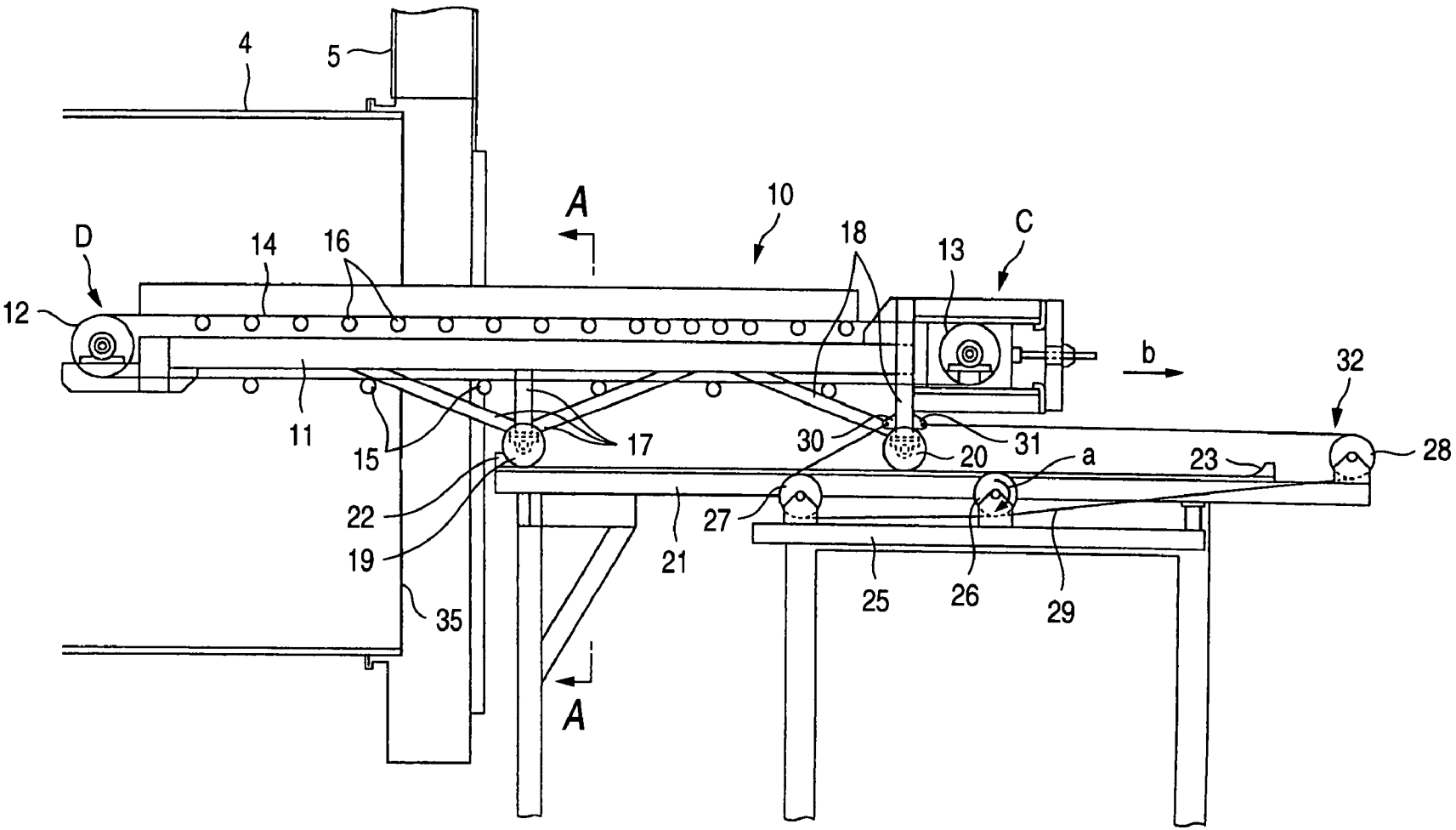
FIG. 18 is a side view on a side of a drum mixer exhaust outlet of the manufacturing apparatus of the sintering material when an exhaust end of an additional coating conveyer is located at a predetermined position on a side of exhaust outlet in a drum mixer.

A configuration of the transfer means 32 will be detailed with reference to FIGS. 18 through 20. FIG. 18 is a side view of an exhaust outlet side of the drum mixer 4 of the manufacturing apparatus of the sintering material when the exhaust end D of the additional coating conveyer 10 is located at a predetermined position on the exhaust outlet side in the drum mixer 4, FIG. 19 being a side view of an exhaust outlet side of the drum mixer of the manufacturing apparatus of the sintering material when the exhaust end D of the additional coating conveyer 10 is located outside of the exhaust outlet 35 of the drum mixer 4, FIG. 20 being an A-A arrow sectional view of FIG. 18.

Figure 19:
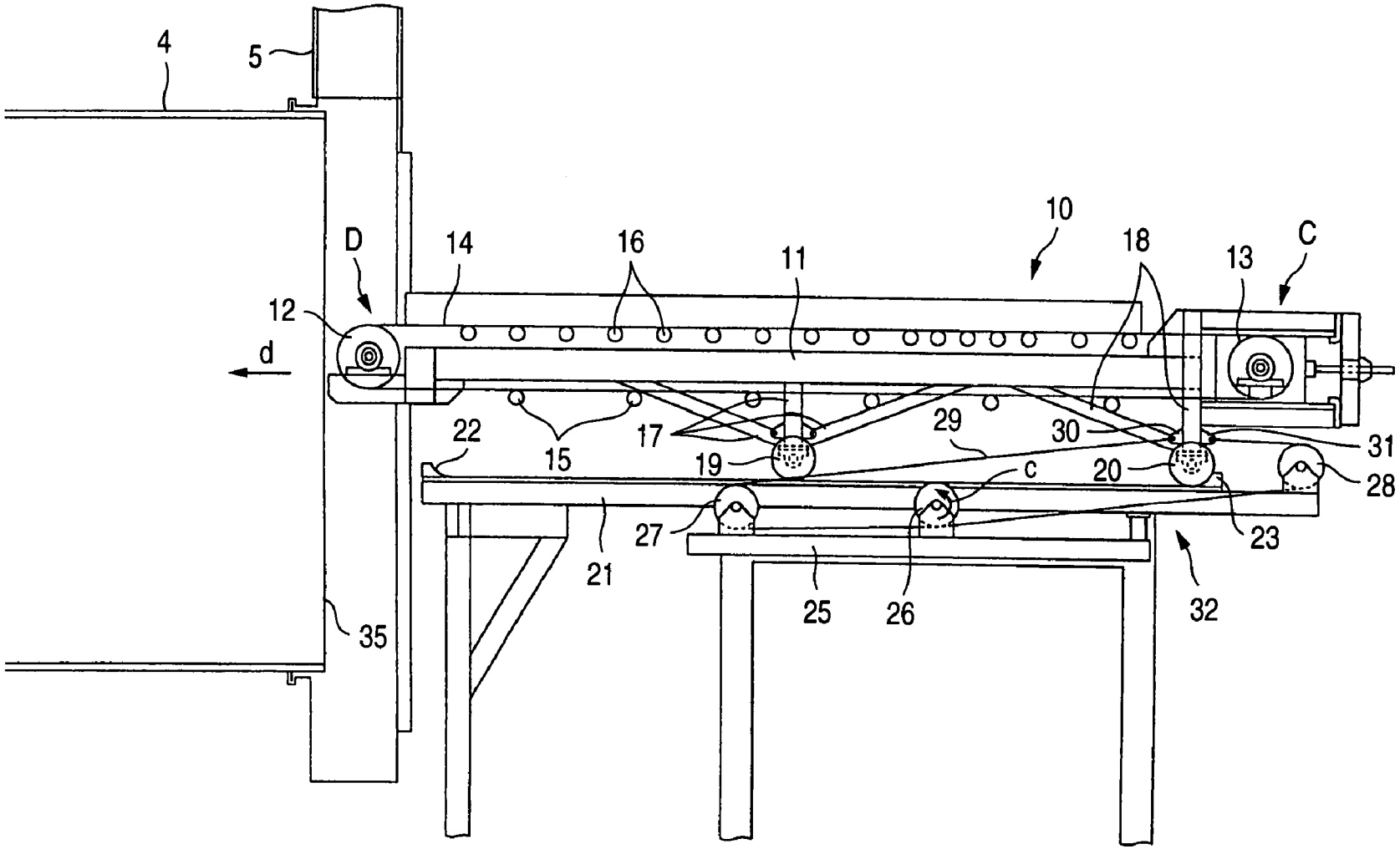
FIG. 19 is a side view on a side of a drum mixer exhaust outlet of the manufacturing apparatus of the sintering material when an exhaust end of an additional coating conveyer is located outside of an exhaust outlet of the drum mixer.

The additional coating conveyer 10, as shown in FIGS. 18 and 19, includes conveyer body 11 extending anteroposteriorly substantially along a longer direction of the drum mixer 4, the exhaust end D (forward end) of the conveyer body 11 being provided with freely rotatable pulley 12, end portion C (back end portion) on a side opposite to the exhaust end of the conveyer body 11 being provided with driving pulley 13. The additional coating conveyer 10, as shown in FIG. 20, is positioned so that a centerline CL in a width direction thereof may be placed shifted by a distance e with respect to a centerline CL of the drum mixer 4. To the driving pulley 13, driving motor 33 (FIG. 16) for rotating and driving the driving pulley 13 is connected. On an exterior periphery of pulley 12 and the driving pulley 13, endless belt 14 is wound, and the belt 14 is driven by rotation and drive of the driving pulley 13. To the driving motor 33, speed control means 34 (FIG. 16) for controlling the speed of the belt 14 of the additional coating conveyer 10 is connected, and an initial projection speed of the additional coating auxiliary raw material 8 that is projected into the drum mixer 4 is made controllable. Then, at a substantial center portion in a longer direction of the conveyer body 11, through a plurality of pillars 17, a pair of wheels 19 is disposed, and at the backward end portion C of the conveyer body 11, through a plurality of pillars 18, a pair of wheels 20 is disposed. These wheels 19 and 20 are disposed movable in an anteroposterior direction on rail 21. At a forward end of the rail 21, forward stopper 22 that limits a forward movement of the wheels 19 disposed in a front side is disposed, and at a backward end of the rail 21, backward stopper 23 that limits a backward movement of the wheels 20 disposed in a back side is disposed. Furthermore, on base 25 erected from the ground, rotation drum 26 connected to not shown rotation control means is disposed. Around the rotation drum 26, wire 29 is wound, one end portion of the wire 29 being engaged through front pulley 27 to engaging portion 30 disposed in front of the pillar 18, on the other hand, the other end portion of the wire 29 being engaged through rear pulley 28 to engaging portion 31 disposed in back of the pillar 18. The pillars 17, 18, wheels 19, 20, rail 21, stoppers 22, 23, base 25, rotation drum 26, front and rear pulleys 27, 28 and wire 29 constitute the transfer means 32. In FIGS. 18 through 20, reference numerals 15, 16 denote transfer rollers.

In the next place, operations of the manufacturing apparatus 1 of the sintering material will be explained with reference to FIGS. 16 through 20.

The sintering material 7 transferred by the raw material conveyer 2 is equally divided by the shoot 3 and charged into the drum mixer 4 from the charge inlet thereof. Then, the sintering material 7, rolling in the drum mixer 4 toward a right direction in FIG. 16, with a coarse particle as a seed particle and with fine particles depositing on the periphery of thereof, the formation of the pseudo particles proceeds.

Figure 20:
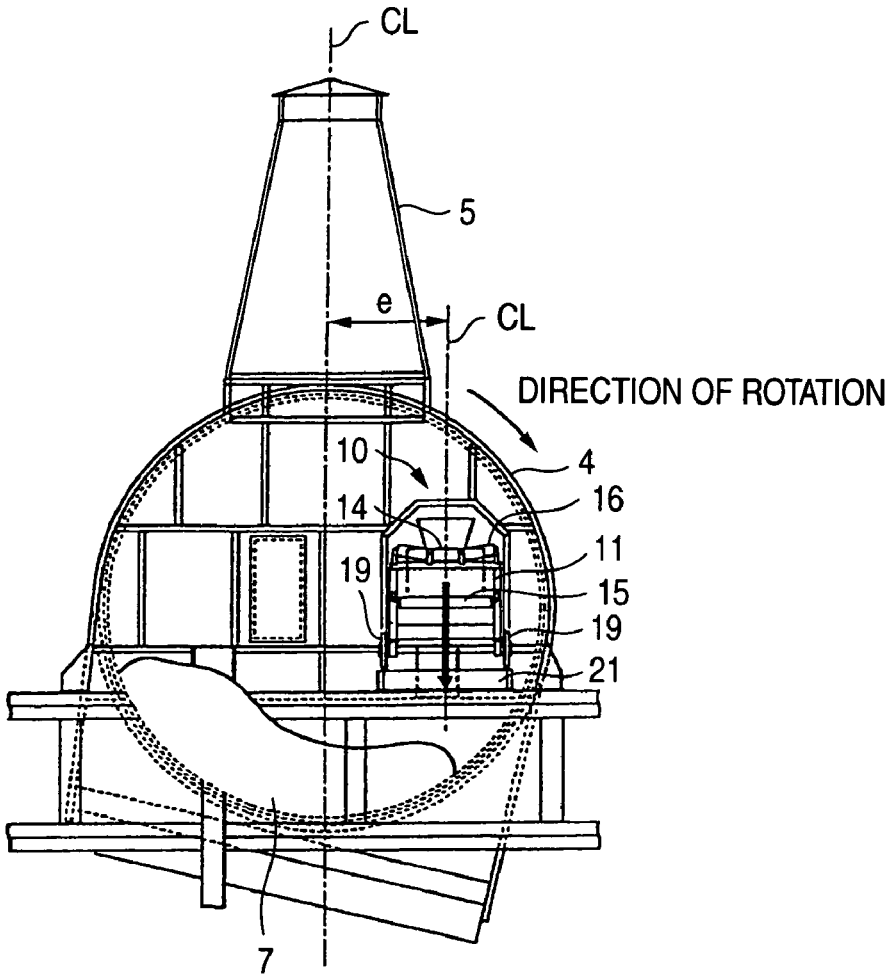
FIG. 20 is an arrow A-A sectional view in FIG. 18.

At a position that is a substantial final step of the formation of the pseudo particle, that is, at a position in the neighborhood of the exhaust outlet 35 of the drum mixer 4, as shown with an arrow mark in FIGS. 16 and 20, to the sintering material 7 that is forming pseudo particles, the additional coating auxiliary raw material 8 is projected from the additional coating conveyer 10. At this time, so that the exhaust end D of the additional coating conveyer 10 may be positioned at a predetermined position (a full line position in FIG. 16, a position of FIG. 18) on a side of the exhaust outlet 35 in the drum mixer 4, the additional coating conveyer 10 has been moved by use of the transfer means 32. By this additional coating operation, the additional coating auxiliary raw material 8 is deposited on the exterior coating portion of the pseudo particle, and thereby an outer shell of the pseudo particle is formed. When the outer shell of the pseudo particle is formed, the shape stability and an improvement in the strength of the pseudo particle result.

The predetermined position on a side of the exhaust outlet 35 in the drum mixer 4 where the exhaust end D of the additional coating conveyer 10 is positioned and the speed of the belt 14 of the additional coating conveyer 10 are preferably controlled so that a projection position of the additional coating auxiliary raw material 8 may be in a region disposed in the middle on a downstream side where a staying time during which the sintering material 7 reaches the exhaust outlet of the drum mixer 4 is in the range of from 10 to 90 seconds. Thereby, in the course of sintering of the sintering material, a reaction between CaO and $SiO_2$ occurs belatedly, calcium silicate (CS) low in the cold strength being suppressed from generating, calcium ferrite (CF) strong in the strength being generated on a surface of the sintered ore, hematite (He) high in the reducibility being selectively generated toward the inside of the sintered ore, the sintered ore rich in the fine pores, excellent in the reducibility, and high in the cold strength being stably manufactured.

Furthermore, from the viewpoint of safety, when the projection of the additional coating auxiliary raw material 8 is continued, since the exhaust end D of the additional coating conveyer 10 is inside of the drum mixer 4, dust powder (calcined lime and so on) in the drum mixer 4 adheres and solidly sticks to the exhaust end D of the additional coating conveyer 10, resulting in causing disturbance in conveyer operation. Accordingly, when the dust powder in the drum mixer 4 adheres a certain extent to the exhaust end D of the additional coating conveyer 10, an operator rotates the rotation drum 26 by rotation control means in a direction shown by an arrow mark a in FIG. 18 to draw out the additional coating conveyer 10 in an arrow mark direction b in FIG. 18, and thereby, as shown in FIG. 19, the exhaust end D of the additional coating conveyer 10 is made to locate at a position outside of the exhaust outlet 35 of the drum mixer 4 (chain double-dashed line position in FIG. 16). When the rotation drum 26 is rotated in a direction shown by the arrow mark a, a portion locating behind the rotation drum 26 of the wire 30 twines around the rotation drum 26, the additional coating conveyer 10 being moved through the wire 30 in an arrow mark b direction. Then, as shown in FIG. 19, in a state where the exhaust end D of the additional coating conveyer 10 is located outside of the exhaust outlet 35 of the drum mixer 4, the operator cleanses a portion of the additional coating conveyer 10 thereto dust powder adhered and removes the accretion.

After the cleaning came to completion, the operator, by use of the rotation control means, rotates the rotation drum 26 in a direction shown by an arrow mark c in FIG. 19 to move the additional coating conveyer 10 in a direction shown by an arrow mark d in FIG. 19, and thereby, as shown in FIG. 18, the exhaust end D of the additional coating conveyer 10 is made to locate at a predetermined position on the exhaust outlet side of the drum mixer 4. When the rotation drum 26 is rotated in a direction shown by the arrow mark c, a portion locating in front of the rotation drum 26 of the wire 30 twines around the rotation drum 26, the additional coating conveyer 10 being moved through the wire 30 in a direction shown by an arrow mark d. Then, as shown in FIG. 18, in a state where the exhaust end D of the additional coating conveyer 10 is located at a predetermined position on the exhaust outlet side in the drum mixer 4, the additional coating auxiliary raw material 8 is projected.

Thus, in the manufacturing apparatus 1 of the sintering material shown in FIGS. 16 through 20, the transfer means 32 for transferring the additional coating conveyer 10 is disposed so that the exhaust end D of the additional coating conveyer 10 may move between a predetermined position on the exhaust outlet side in the drum mixer 4 and a position outside of the exhaust outlet 35 of the drum mixer 4, accordingly, at the maintenance operation by which the accretion adhered to the additional coating conveyer 10 is removed, the additional coating conveyer 10 can be easily drawn out, resulting in easily performing the maintenance operation within a short time.

As shown in FIG. 16, speed control means 34 for controlling the speed of the belt 14 of the additional coating conveyer 10 is disposed so as to enable to control an initial projection speed of the additional coating auxiliary raw material 8 that is projected into the drum mixer 4. Accordingly, when a position on the exhaust outlet side in the drum mixer 4 wherein the exhaust end D of the additional coating conveyer 10 is positioned is made closer to the exhaust outlet 35 and the initial projection speed of the additional coating auxiliary raw material 8 is made faster when the additional coating auxiliary raw material 8 is projected, a projection position of the additional coating auxiliary raw material 8 can be made the same state as that when the initial projection speed is made slower. As a result, the position on the exhaust outlet side in the drum mixer 4 wherein the exhaust end D of the additional coating conveyer 10 is positioned can be made closer to the exhaust outlet 35, accordingly, an adhering speed of the accretion that adheres to the additional coating conveyer 10 can be made slower and the frequency of the maintenance operation for removing the accretion adhered to the additional coating conveyer 10 can be made smaller.

Figure 24:
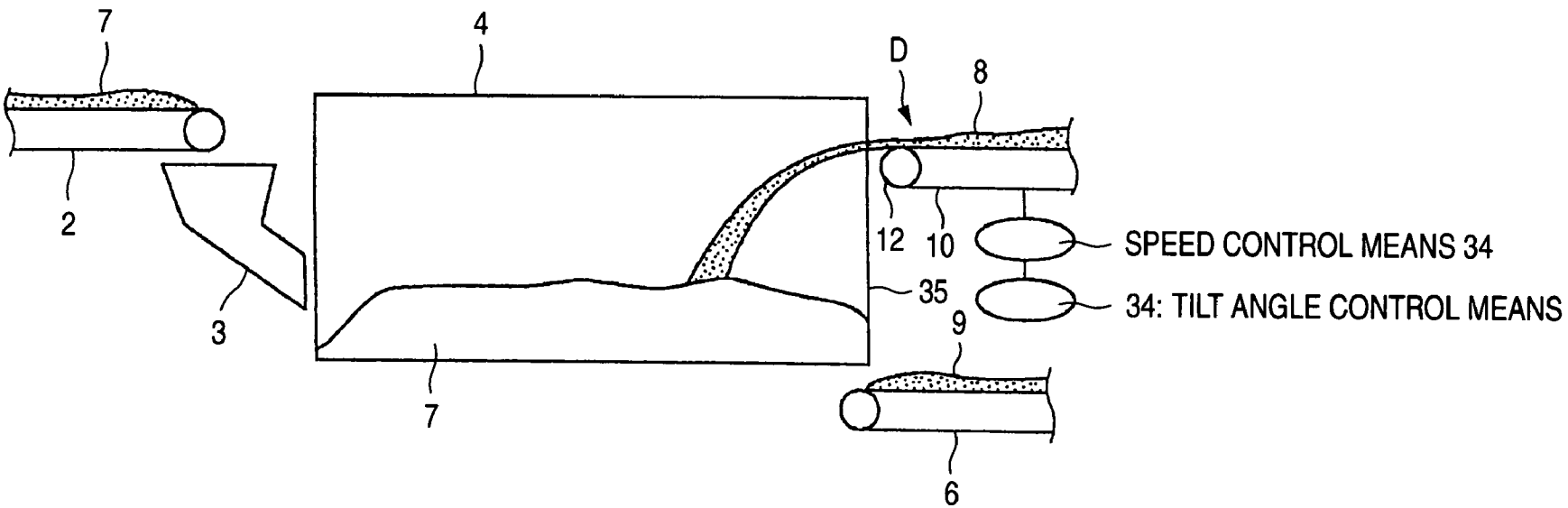
FIG. 24 is a side view showing an outline of the manufacturing apparatus of the sintering material when the exhaust end of an additional coating conveyer is positioned outside of an exhaust outlet of the drum mixer.

On the other hand, in order to inhibit the dust powder from adhering to the exhaust end D of the additional coating conveyer 10, as shown in FIG. 24, by positioning the exhaust end D of the additional coating conveyer 10, without inserting into the drum mixer 4, always outside of the exhaust outlet 35 of the drum mixer 4, and by projecting with a larger initial projection speed of the additional coating auxiliary raw material 8 that is projected into the drum mixer 4, the additional coating auxiliary raw material 8 can be allowed to reach inside of the drum mixer to additionally coat.

In the above, modes for carrying out the invention were explained; however, the present invention, without restricting thereto, may be variously changed and improved.

For instance, the transfer means 32 shown in FIGS. 18 and 19, as far as it can move the additional coating conveyer 10 so that the exhaust end D of the additional coating conveyer 10 may move between a predetermined position on the exhaust outlet side in the drum mixer 4 and a position outside of the exhaust outlet 35 of the drum mixer 4, need not include the pillars 17, 18, wheels 19, 20, rail 21, stoppers 22, 23, base 25, rotation drum 26, front and rear pulleys 27, 28, and wire 29.

Furthermore, as far as a additional coating mode where the additional coating conveyer 10 is inserted (intruded) into the drum mixer 4 to additionally coat is taken, the speed control means 34 for controlling the speed of the belt 14 of the additional coating conveyer 10 is not necessarily disposed.

Figure 17A:
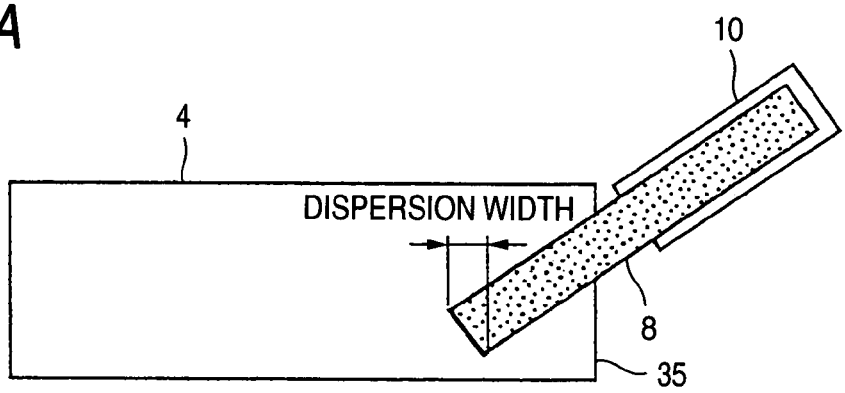
FIG. 17A is a plan view showing one example of means for expanding a range of dispersion of an additional coating auxiliary raw material.
Figure 17B:
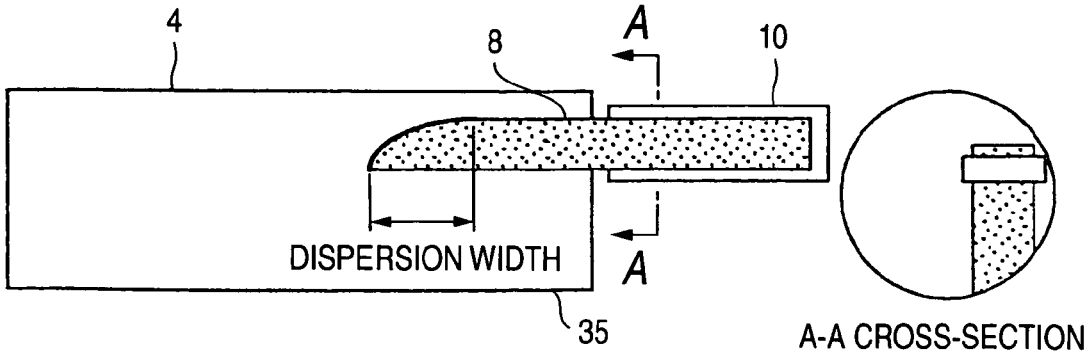
FIG. 17B includes a plan view and a partial sectional view showing another example of means for expanding a range of dispersion of an additional coating auxiliary raw material.

In the additional coating experiment of the auxiliary raw material, the belt conveyer 10 is not provided with an angle of elevation, however, the additional coating conveyer 10 is preferably provided with elevation angle control means so that not only the initial speed but also the elevation angle may be controlled. Furthermore, when a additional coating angle of the additional coating conveyer 10 and/or a additional coating position in a width direction in the drum mixer 4 is made variable, a dispersion range of the additional coating auxiliary raw material 8 can be preferably widened. In FIG. 17, an example of means for expanding a dispersion range of the additional coating auxiliary raw material is shown. FIG. 17A is a plan view showing a case where by additionally coating with the additional coating conveyer 10 disposed slanted to an axial direction of the drum mixer 4, a dispersion range of the additional coating auxiliary raw material 8 is expanded. FIG. 17B is a plan view and an A-A arrow sectional view showing a case where by disposing the additional coating conveyer 10 decentered from a center axis of the drum mixer 4 to additionally coat, a dispersion range of the additional coating auxiliary raw material 8 is expanded.

EMBODIMENTS

Embodiment 1

Pseudo particles that had been granulated according to the granulation flow (method A) of the invention from a sintering material having a compounding ratio shown in Table 2 were transferred to a Dwight-Lloyd type sintering machine and charged on a palette. For comparison, pseudo particles that had been granulated according to a treatment method where iron ore M1, $SiO_2$-containing material M2, limestone base material M3 and coke powder M4 are simultaneously mixed were transferred to a Dwight-Lloyd type sintering machine and charged on a palette. Thereafter, the sintering was performed on the palette followed by measurements of ore composition and the reducibility. Measurements of ones according to the inventive method and the conventional method are shown in Table 3. The measurement was performed of the sintered ore obtained by Dwight-Lloyd type sintering machine having a production capacity of 9300 tons/day.

Figure 13:
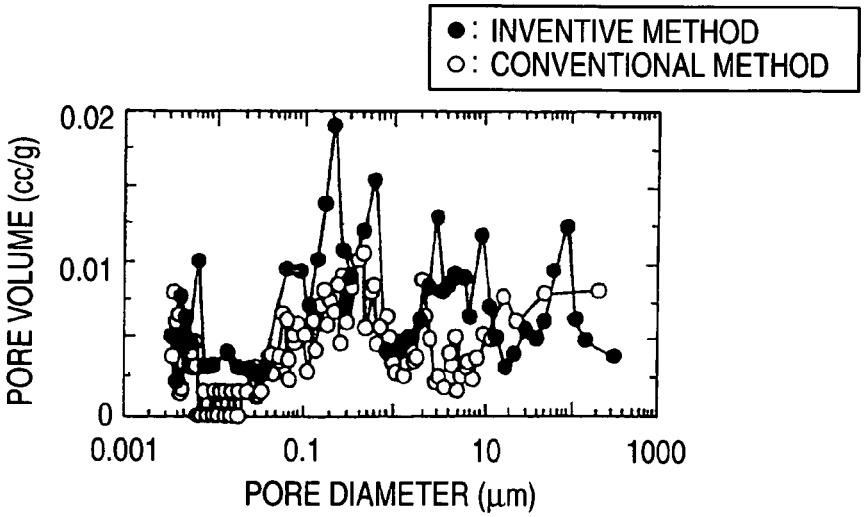
FIG. 13 is a diagram showing pore distribution in the sintered ore according to the invention in comparison with that of a conventional example.

As shown in Table 3, when the granulation method according to the invention is adopted, as to the ore composition, hematite (He) high in the reducibility increased, calcium silicate (CS) low in the reducibility decreased, and, as shown in FIG. 13, fine pores due to hematite (He) increased; accordingly, the reducibility increased by 5% in comparison with one according to the conventional method.

Furthermore, pseudo particles manufactured according to the granulation method (method B) of the invention were similarly supplied to Dwight-Lloyd type sintering machine followed by sintering. Results were similar to the above.

Figure 1:
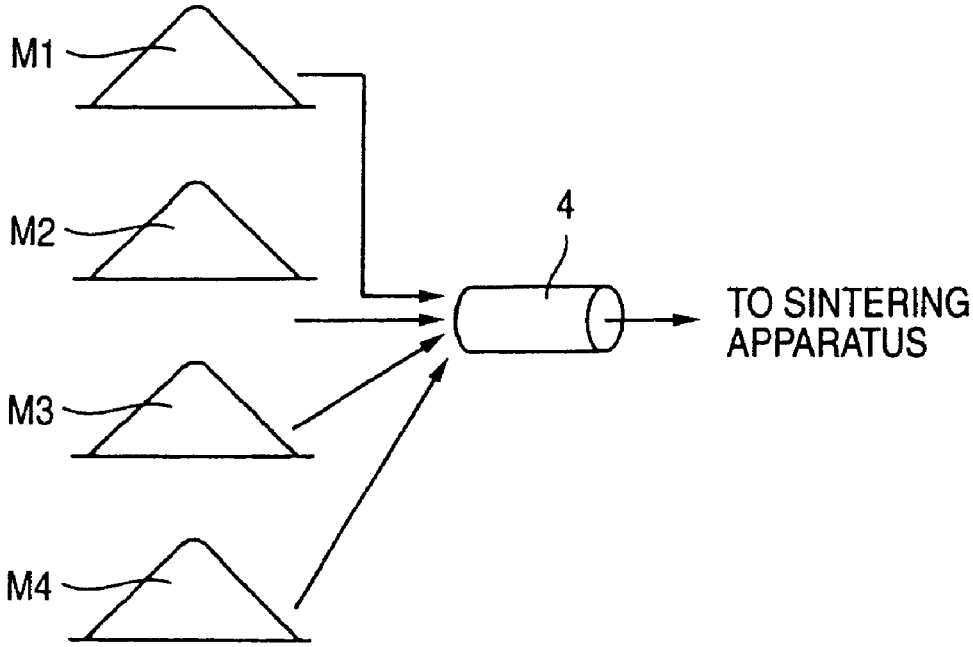
FIG. 1 Related Art
FIG. 1 is a system diagram of mixing and granulating a sintering material involving a conventional example.
Figure 2:
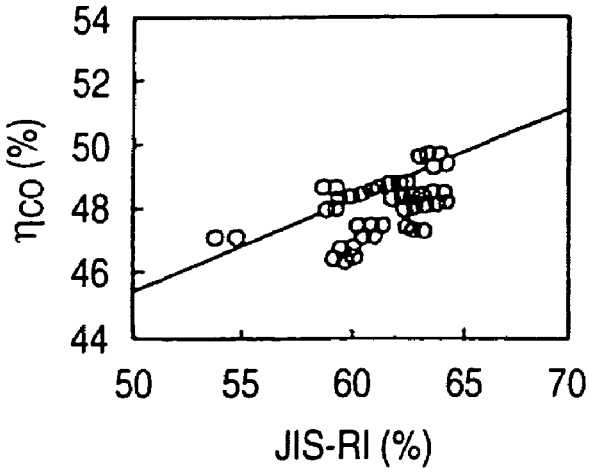
FIG. 2 is a diagram showing relationship between the reducibility JIS-RI (%) of a sintered ore and gas utilization factor $\eta_{co}$ (%) in a blast furnace.
Figure 3:
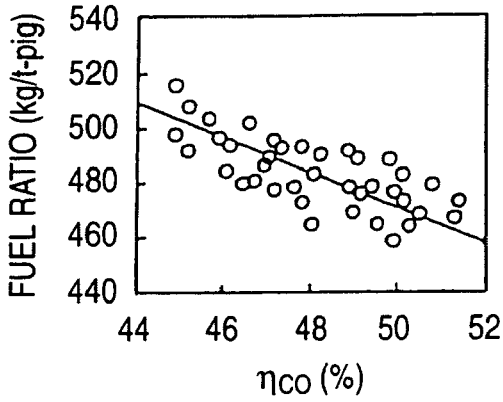
FIG. 3 is a diagram showing relationship between the gas utilization factor $\eta_{co}$ (%) and the fuel ratio (kg/t-pig) in a blast furnace.
Figure 4:
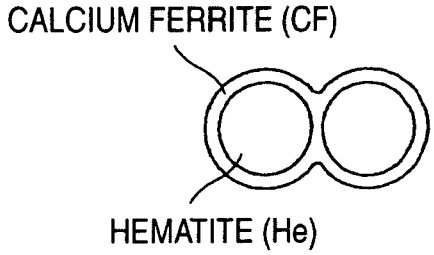
FIG. 4 is a diagram explaining a texture structure of a desirable sintered ore in the invention.
Figure 5:
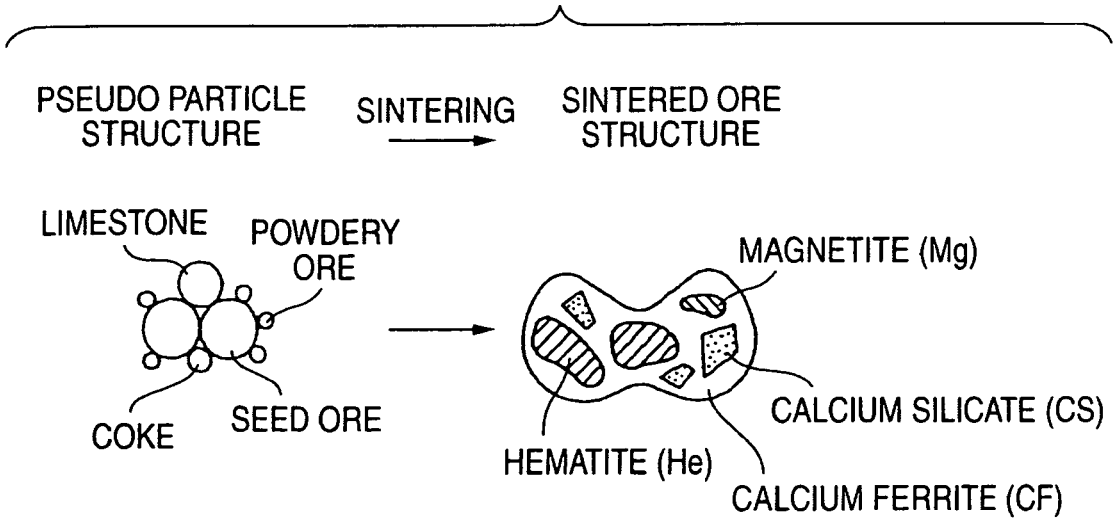
FIG. 5 is a diagram explaining a pseudo particle structure and a texture structure of a sintered ore according to a conventional example.
Figure 14:
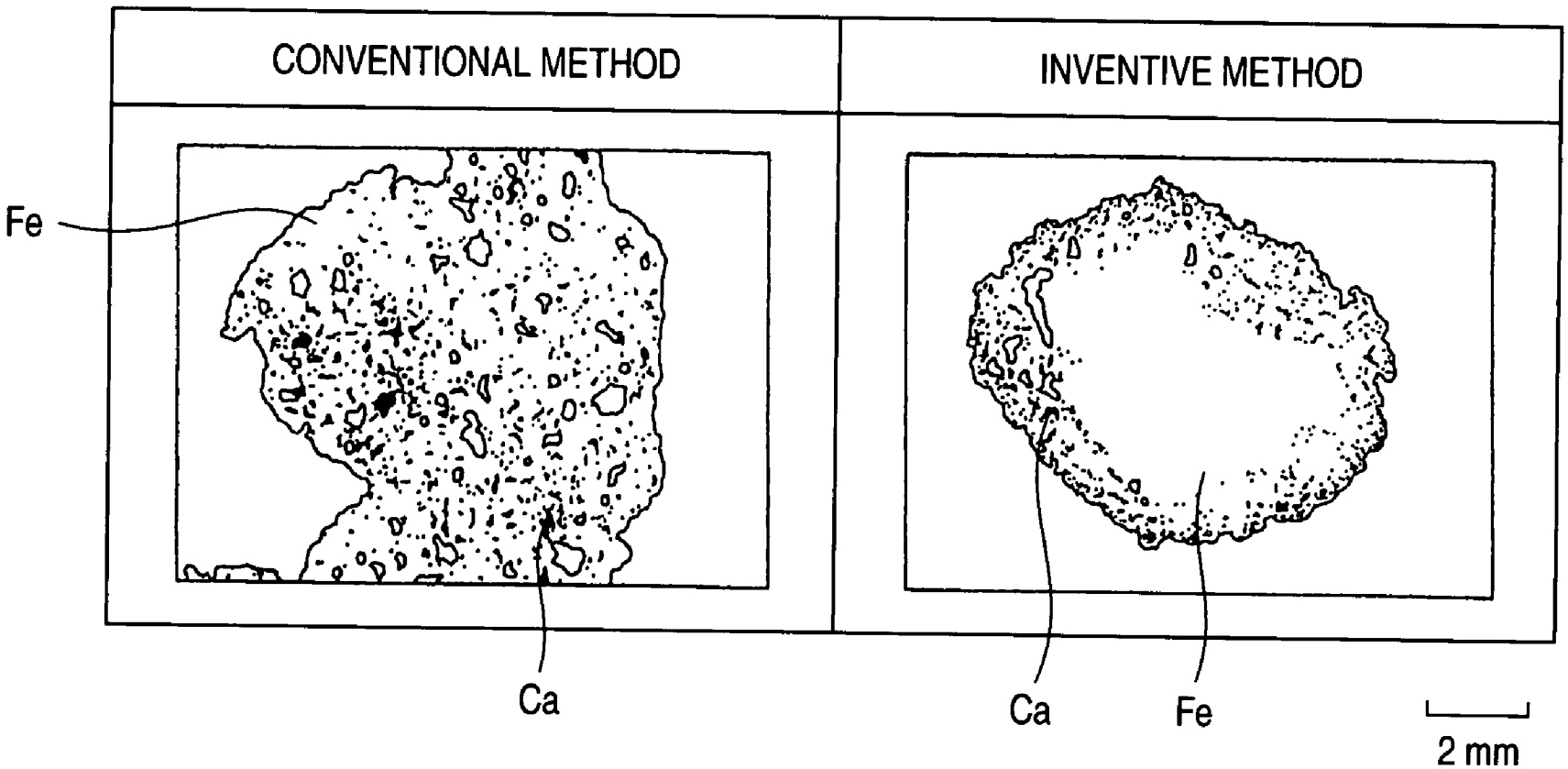
FIG. 14 is a diagram showing measurements by EPMA of cross sections of sintered bodies of pseudo particles according to the inventive and the conventional methods.

Still furthermore, results of EPMA measurement of cross sections of sintered bodies of the pseudo particles according to the inventive method and conventional method are shown in FIG. 14. FIG. 14 is obtained by tracing an EPMA photograph, and with a Ca portion blacked out and with a Fe portion outlined, a dispersion state of Ca is made seeable with ease. While in the conventional one, Ca (black portion) distributes universally, in the inventive one, Ca is found only in the exterior coating portion. Accordingly, it is confirmed that owing to the application of the exterior coating of limestone according to the inventive method, hematite remains inside of the sintered ore, and in the surroundings thereof calcium ferrite is generated. That is, it is confirmed that a sintered structure such as shown in FIG. 4 in which on the surface of the sintered ore calcium ferrite (CF) high in the strength is generated and toward the inside portion of the sintered ore hematite (He) high in the reducibility is selectively generated could be obtained.

Furthermore, pseudo particles manufactured according to the granulation method (method C) of the invention were similarly supplied to Dwight-Lloyd type sintering machine followed by sintering. Results of the sintering and EPMA measurements were similar to the above.

Figure 15:
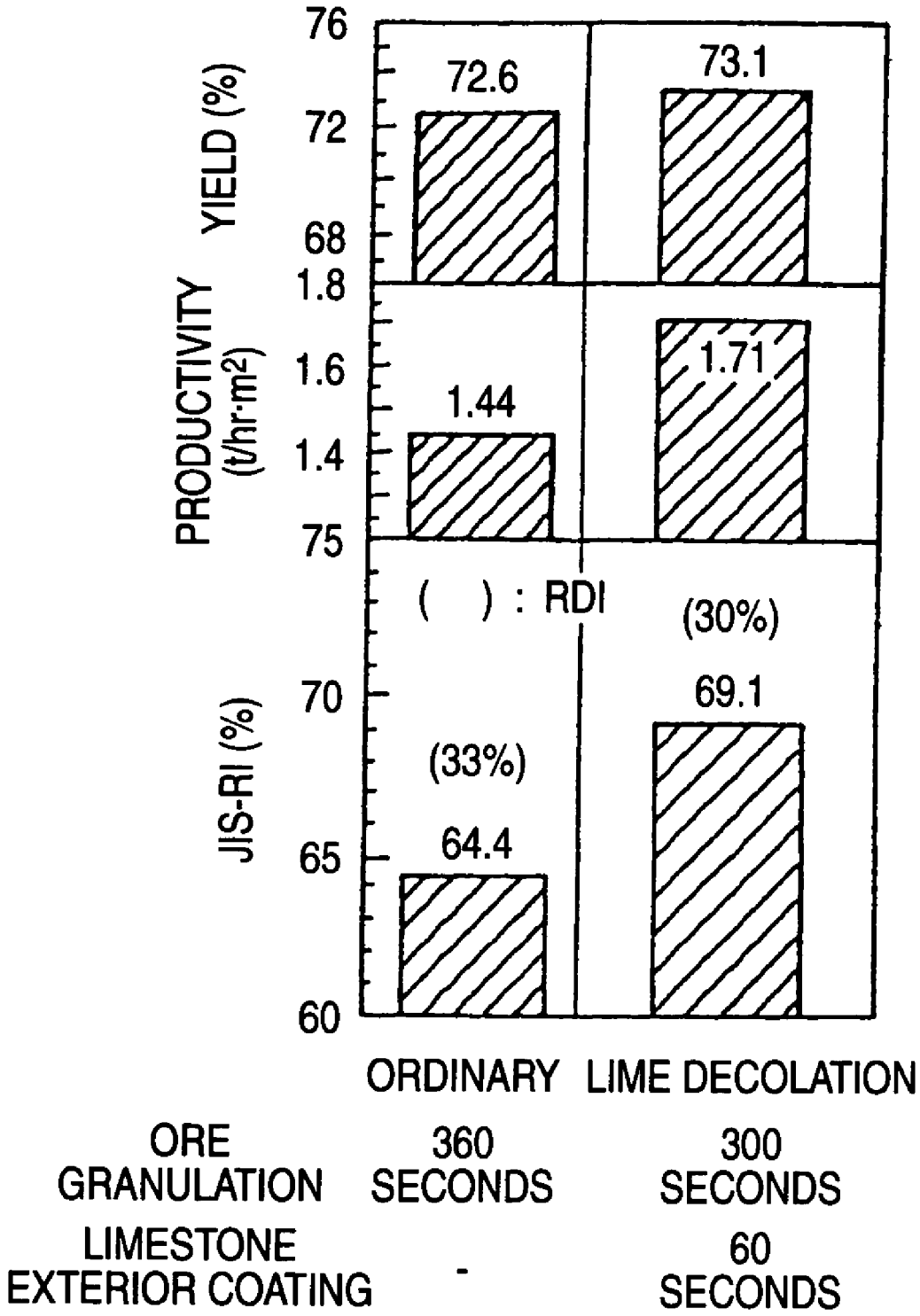
FIG. 15 is a diagram showing the reducibility JIS-RI (%), yield and productivity involving the invention in comparison with those of the conventional example.

FIG. 15 shows results of measurements of the reducibility (JIS-RI), yield, and productivity. According to the inventive method, in comparison with one according to the conventional method, the reducibility JIS-RI is increased by substantially 5%, the yield is improved by 0.5% and the productivity is improved by substantially 18%.

Embodiment 2

Figure 21:
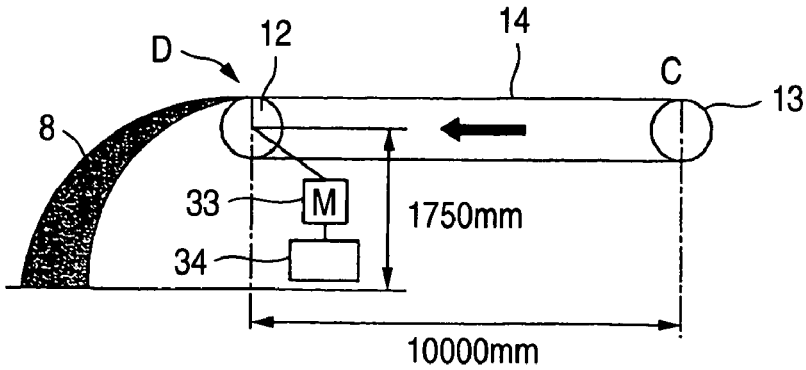
FIG. 21 is a schematic side view of apparatus for projection experiment of an additional coating auxiliary raw material.

With the apparatus shown in FIG. 21, projection experiment of the additional coating auxiliary raw material was performed. The apparatus shown in FIG. 21 is equipped with driving pulley 12 at one end and freely rotatable pulley 13 at the other end, and around outer peripheries of the driving pulley 12 and the pulley 13, endless belt 14 is wound. To the driving pulley 12, driving motor 33 that rotationally drives the driving pulley 12 is connected, the belt 14 being made to operate owing to the rotational drive of the driving pulley 12. To the driving motor 33, speed control means 34 for controlling the speed of the belt 14 of the additional coating conveyer is connected, and thereby an initial projection speed of the additional coating auxiliary raw material 8 can be controlled. A drop distance from a center of the driving pulley 12 to the ground is 1750 mm (1.75 m), a distance between the driving pulley 12 and the pulley 13 being 10000 mm (10 m).

In the projection experiment, projections were performed with the speed of the belt 14 set at 4 levels of 60 m/min, 180 m/min, 240 m/min and 300 m/min, and with the projection elevation angle of the additional coating auxiliary raw material 8 set at 0 degree, and projection distances from a central axis line of the driving pulley 12 to a position where the additional coating auxiliary raw material 8 reached the ground were measured.

Furthermore, when the additional coating auxiliary raw material 8 is projected, theoretical calculation values of a projection distance from the central axis line of the driving pulley 12 to a place where the additional coating auxiliary raw material 8 reaches the ground and a drop distance from a center of the driving pulley 12 to the ground can be expressed by the following (1) and (2) equations when calculated without considering the air resistance.

$$\text{Projection distance}=V\times\cos\theta\times t \quad (1)$$

$$\text{Drop distance}=V\times\sin\theta\times t-g\times t^2/2 \quad (2)$$

In the above equations, θ, V, and t, respectively, denote a projection elevation angle, a speed of the belt, and time. g denotes gravitational acceleration.

Figure 22:
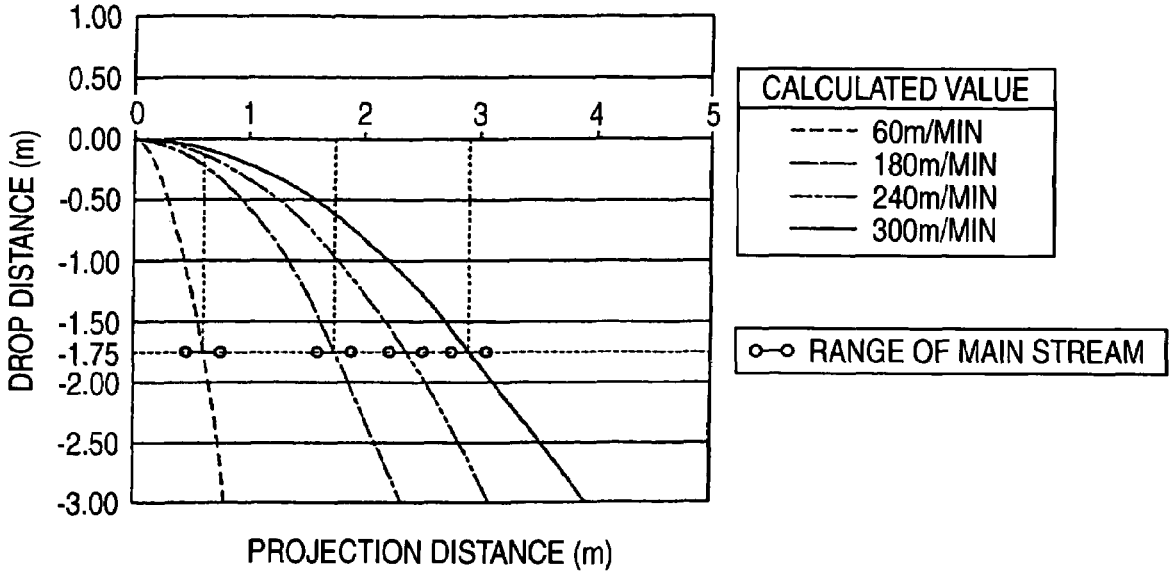
FIG. 22 is a graph comparing measurements and calculated values of projection distance.

Then, measurements and calculated values of the projection distance were compared. Results thereof are shown in FIG. 22. In FIG. 22, when calculating the calculated values of the drop distance and projection distance, the projection elevation angle θ was set at 0 degree.

With reference to FIG. 22, it is found that measurements (main stream range) and calculated values of the projection distance when the drop distance is set at 1.75 m overlap each other for all of 4 levels of belt speed of 60 m/min, 180 m/min, 240 m/min, and 300 m/min.

Accordingly, in the manufacturing apparatus 1 of the sintering material shown in FIGS. 16 through 20, a predetermined position on the exhaust outlet side in the drum mixer 4 wherein the exhaust end D of the additional coating conveyer 10 is located and a speed of the belt 14 of the additional coating conveyer 10 can be adjusted based on the above equations (1) and (2).

Embodiment 3

Furthermore, with the apparatus shown in FIG. 21, the additional coating auxiliary raw material 8 of transfer amount of 8 kg/s (coke: 3 kg/s and limestone: 5 kg/s) was projected at a speed of the belt 14 of 300 m/s and a projection elevation angle of 0 degree, and the dispersibility was investigated. Results are shown in FIG. 23.

Figure 23:
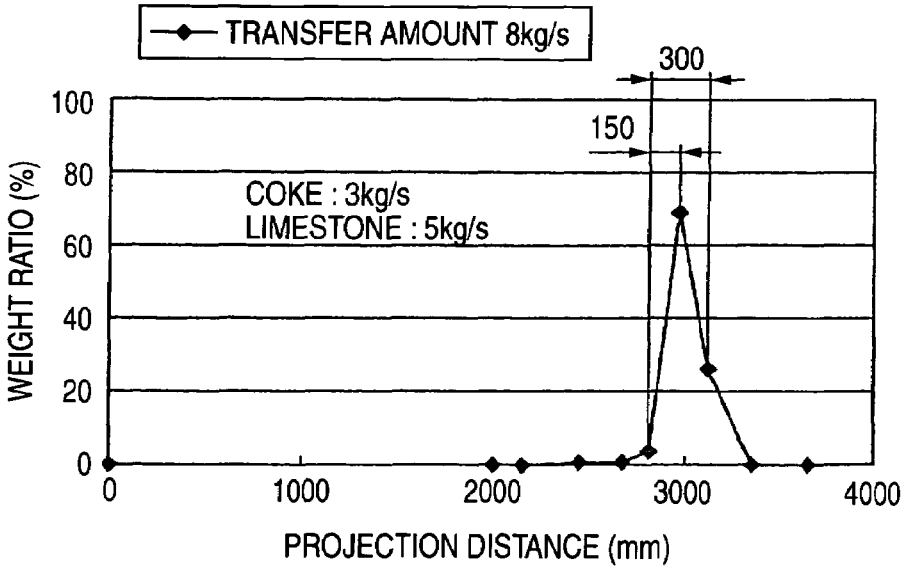
FIG. 23 is a graph showing investigation results of dispersibility when an additional coating auxiliary raw material of a transfer amount of 8 kg/s (coke: 3 kg/s and limestone: 5 kg/s) is projected at a belt speed of 300 m/s and an angle of elevation of 0 degree.

With reference to FIG. 23, it can be understood that in the neighborhood of the projection distance of 3000 mm (3 m), within a width of 300 mm, more than 90% of weight exists. Accordingly, in the manufacturing apparatus 1 of the sintering material shown in FIGS. 16 through 20, the additional coating auxiliary raw material 8 projected from the additional coating conveyer 10 can be additionally coated without being unnecessarily dispersed in the projection position. Accordingly, the manufacturing apparatus 1 can be sufficiently utilized as apparatus that adds a limestone base powdery material and a solid fuel type powdery material that is a heat source in a exterior coating region disposed in the middle on a downstream side until pseudo particles of material for use in sintering reaches the exhaust outlet of the drum mixer.

INDUSTRIAL APPLICABILITY

As mentioned above, according to the manufacturing method of the sintering material of the invention, when the limestone base powdery material and solid fuel type powdery material that is a heat source are added in the exterior coating region disposed in the middle on a downstream side until pseudo particles reach the exhaust outlet of the drum mixer, a pseudo particle material for use in sintering in which the limestone base powdery material and solid fuel type powdery material that is a heat source are deposited and formed on the exterior coating portion of the pseudo particles can be manufactured. Accordingly, in the course of sintering with Dwight-Lloyd type sintering machine, calcium silicate (CS) low in the cold strength is suppressed from generating, calcium ferrite (CF) high in the strength is formed on the surface of the sintered ore, and hematite (He) high in the reducibility is selectively formed toward the inside of the sintered ore. As a result, the sintered ore rich in the fine pores, excellent in the reducibility and high in the cold strength can be manufactured with high productivity.

Other than the above, manufacturing apparatus of the sintering material suitable for the sintered ore that is simple, economical and easy in the maintenance of the apparatus can be provided.

TABLE 1

| | Hematite (He) | Calcium ferrite (CF) | Calcium silicate (CS) | Magnetite (Mg) |
|---|---|---|---|---|
| Reducibility (%) | 50 | 34 | 3 | 27 |
| Tensile strength (MPa) | 49 | 102 | 19 | 58 |

TABLE 2

| Brand | Compounding ratio (%) | Particle size (mm) |
|---|---|---|
| Iron ore (coarse particle) | 82 | 3.0 |
| $SiO_2$-containing material (fine particle) | 3 | 1.0 |
| Limestone base powdery material | 10 | 1.5 |
| Coke powder | 5 | 0.8 |

TABLE 3

| | Measurements | | | | |
|---|---|---|---|---|---|
| | Ore composition (% by mass) | | | | |
| Granulation method | Hematite (He) | Calcium ferrite (CF) | Calcium silicate (CS) | Magnetite (Mg) | Reducibility (%) |
| Inventive method (exterior coating time: 60 s) | 51.2 | 27.3 | 11.3 | 10.2 | 70 |
| Conventional method | 42.0 | 33.9 | 13.2 | 10.9 | 65 |

The invention claimed is:

1. A manufacturing method of a material for use in sintering characterized in that, as a pretreatment of a manufacturing process of a sintered ore for use in a blast furnace with a Dwight-Lloyd type sintering machine of downward suction, when a sintering material including iron ore, a $SiO_2$-containing material, a limestone base powdery material and a solid fuel type powdery material is granulated by use of a drum mixer, the method comprises:

charging sintering material, excepting the limestone base powdery material and solid fuel type powdery material, to a charge inlet of the drum mixer, granulating the sintering material in the drum mixer, and charging an additional coating auxiliary raw material to the drum mixer in a region disposed in a downstream side of the drum mixer and at a location where a staying time during which the sintering material reaches up to an exhaust outlet of the drum mixer is in the range of from 10 to 90 seconds, and thereby until reaching the exhaust outlet, the additional coating auxiliary raw material is deposited and formed on a exterior coating portion of the granulated sintering material.

2. The manufacturing method of a material for use in sintering as set forth in claim 1 characterized in that the additional coating auxiliary raw material is the limestone base powdery material and the solid fuel type powdery material.

3. The manufacturing method of a material for use in sintering as set forth in claim 2 characterized in that the limestone base powdery material is charged to the drum mixer, and the solid fuel type powdery material is charged to the drum mixer, and thereby until reaching the exhaust outlet the limestone base powdery material and the solid fuel type powdery material are deposited and formed, successively, on the exterior coating portion of the sintering material.

4. The manufacturing method of a material for use in sintering as set forth in claim 1 characterized in that the drum mixer is divided into a plurality of drum mixers, and a final drum mixer is set at a drum mixer length in which a staying time reaching from the charge inlet up to the exhaust outlet is set in the range of from 10 to 90 seconds.

5. The manufacturing method of a material for use in sintering as set forth in claim 4 characterized in that the additional coating auxiliary raw material is added in a region disposed in a downstream side where a staying time during which the sintering material reaches an exhaust outlet of the final drum mixer is in the range of from 10 to 90 seconds, and thereby until reaching the exhaust outlet, the additional coating auxiliary raw material is deposited and formed on the exterior coating portion of the sintering material.

6. A manufacturing apparatus of a sintering material characterized in that in a manufacturing apparatus including a drum mixer by which a sintering material is, while rolling and transferring, formed into pseudo particles; and an additional coating conveyer that projects an additional coating auxiliary raw material into the drum mixer after forming pseudo particles of the sintering material, on an exhaust outlet side of the drum mixer, wherein an additional coating conveyer and its exhaust end are positioned outside of the drum mixer so that the exhaust end thereof faces the exhaust outlet of the drum mixer.

7. The manufacturing apparatus of a sintering material as set forth in claim 6 characterized in that the additional coating conveyer is capable of controlling one or both of an initial speed and/or an elevation angle of the additional coating auxiliary raw material with which the additional coating auxiliary raw material for additional coating is projected into the drum mixer.

8. The manufacturing apparatus of a sintering material as set forth in claim 6 characterized in that it further includes movement means for moving the additional coating conveyer so that the exhaust end of the additional coating conveyer moves between a predetermined position on an exhaust outlet side inside of the drum mixer and an outside position of the exhaust outlet of the drum mixer.

9. The manufacturing apparatus of a sintering material as set forth in claim 6 characterized in that it further includes speed control means for controlling a belt speed of the additional coating conveyer, thereby controlling an initial projection speed of the additional coating auxiliary raw material that is projected into the drum mixer.

10. The manufacturing apparatus of a sintering material as set forth in claim 9 characterized in that the exhaust end of the additional coating conveyer is positioned on the exhaust outlet side inside of the drum mixer, and the belt speed of the additional coating conveyer is controlled so that a projection position of the additional coating auxiliary raw material is in a region disposed in a downstream side where a staying time during which the sintering material reaches the exhaust outlet of the drum mixer is in the range of from 10 to 90 seconds.

11. The manufacturing method of a material for use in sintering as set forth in claim 2 characterized in that the drum mixer is divided into a plurality of drum mixers, and a final drum mixer is set at a drum mixer length in which a staying time reaching from the charge inlet up to the exhaust outlet is set in the range of from 10 to 90 seconds.

12. The manufacturing method of a material for use in sintering as set forth in claim 3 characterized in that the drum mixer is divided into a plurality of drum mixers, and a final drum mixer is set at a drum mixer length in which a staying time reaching from the charge inlet up to the exhaust outlet is set in the range of from 10 to 90 seconds.

13. The manufacturing method of a material for use in sintering as set forth in claim 2 characterized in that the drum mixer is divided into a plurality of drum mixers, and the additional coating auxiliary raw material is added in a region disposed in a downstream side where a staying time during which the sintering material reaches an exhaust outlet of the final drum mixer is in the range of from 10 to 90 seconds, and thereby until reaching the exhaust outlet, the additional coating auxiliary raw material is deposited and formed on the exterior coating portion of the sintering material.

14. The manufacturing method of a material for use in sintering as set forth in claim 3 characterized in that the drum mixer is divided into a plurality of drum mixers, and the additional coating auxiliary raw material is added in a region disposed in a downstream side where a staying time during which the sintering material reaches an exhaust outlet of the final drum mixer is in the range of from 10 to 90 seconds, and thereby until reaching the exhaust outlet, the additional coating auxiliary raw material is deposited and formed on the exterior coating portion of the sintering material.

15. The manufacturing apparatus of a sintering material as set forth in claim 7 characterized in that it further includes movement means for moving the additional coating conveyer so that the exhaust end of the additional coating conveyer moves between a predetermined position on an exhaust outlet side inside of the drum mixer and an outside position of the exhaust outlet of the drum mixer.

16. The manufacturing apparatus of a sintering material as set forth in claim 7 characterized in that it further includes speed control means for controlling a belt speed of the additional coating conveyer, thereby controlling an initial projection speed of the additional coating auxiliary raw material that is projected into the drum mixer.

17. The manufacturing apparatus of a sintering material as set forth in claim 8 characterized in that it further includes speed control means for controlling a belt speed of the additional coating conveyer, thereby controlling an initial projection speed of the additional coating auxiliary raw material that is projected into the drum mixer.

* * * * *